United States Patent [19]

Novak et al.

[11] Patent Number: 4,921,211

[45] Date of Patent: May 1, 1990

[54] METHOD AND APPARATUS FOR FLOW CONTROL

[75] Inventors: Joel S. Novak, Sudbury; Natan E. Parsons, Brookline; Kenneth M. Steiner, Sudbury, all of Mass.

[73] Assignee: Recurrent Solutions Limited Partnership, Cambridge, Mass.

[21] Appl. No.: 315,921

[22] Filed: Feb. 24, 1989

[51] Int. Cl.[5] ..... F16K 31/06; E03C 5/10

[52] U.S. Cl. ..... 251/129.04; 4/623

[58] Field of Search ..... 251/129.04; 4/623

[56] References Cited

U.S. PATENT DOCUMENTS 4,520,516 6/1985 Parsons ..... 4/623

4,788,998 12/1988 Pepper ..... 251/129.04 X

*Primary Examiner*—Arnold Rosenthal

*Attorney, Agent, or Firm*—Nutter, McClennen & Fish

[57] ABSTRACT

An automatic faucet (100) includes a faucet (102) through which flow is controlled by an electronically operated valve (108). A sensing apparatus (104) senses the motion of objects below the faucet (102) and causes the valve (108) to open when sensed objects exhibit motion that meets certain predetermined criteria. Operation of the valve (108) in response to motion that is not intended to cause water flow is reduced by a technique that involves computing an "average" distance, which represents the position assumed by a sensed stationary object. Specifically, objects sensed near the average distance must exhibit motion more consistently than other objects because the former objects are more likely to be splashing water, which should not result in the valve's being opened. Also, some motion greater than 1.5 inches between sensing cycles is ignored because there is a significant likelihood that such apparent motion is caused by the intermittent "disappearance" of a standing-water surface acting as a sonic mirror. To reduce the undesirable insensitivity that might otherwise result from this 1.5-inch threshold, the threshold is increased to 3 inches when the apparent motion does not include a position separated from the sensor by more than the average distance.

6 Claims, 18 Drawing Sheets

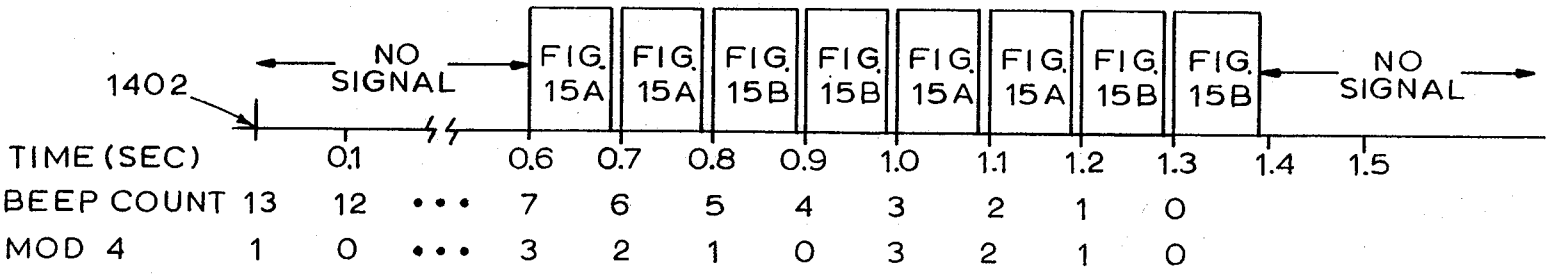
FIG. 14
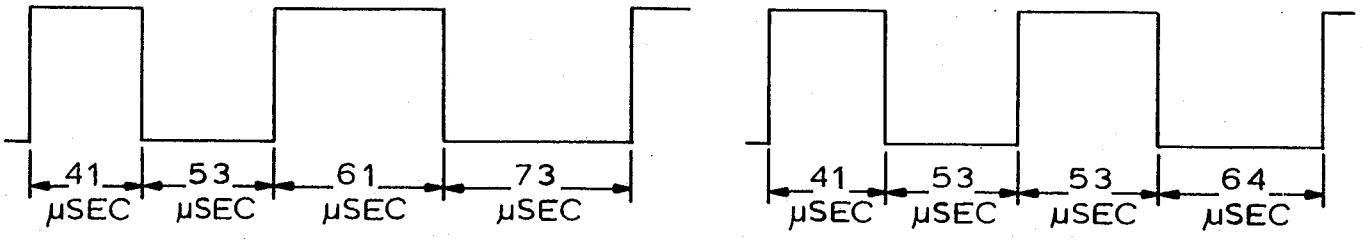
FIG. 15A
FIG. 15B

METHOD AND APPARATUS FOR FLOW CONTROL

BACKGROUND OF THE INVENTION

The present invention is directed to motion-base systems for controlling the flow of fluids such as water. It is directed particularly to avoiding flow resulting from erroneous motion or from motion of splashing water.

U.S. Pat. No. 4,520,516 to Parsons describes a flow control system in which flow through a faucet or other conduit is controlled in response to objects in the vicinity of the faucet outlet. The arrangement described in the Parsons patent is particularly suited to kitchen sinks and similar locations since it controls flow in response to the object's motion rather than its mere presence. As a result, a stack of dishes under the faucet does not cause water to flow unless the user moves one of the dishes.

The Parsons arrangement employs ultrasound, transmitting it into the target region and sensing any resultant echo. The time of occurrence of the resulting echo is an indication of the distance to the object that caused it, and differences between successive distance measurements are taken as an indication of object motion.

In short, controlling the valve in response to object motion causes the water to flow in almost all situations in which flow is desired, yet it avoids causing water to flow in many situations in which triggering on simple object presence would cause unintended flow.

However, there still remain certain conditions under which unintended flow occurs even with a motion-based control scheme. In most of these conditions, it is the water itself whose motion causes the unintended flow. For instance, water dripping from the faucet causes splashing at the water surface, and the resultant motion can cause the water to flow. That flow causes more motion, and the water keeps flowing even though it should not.

Another condition is the presence of standing water. Standing water can act as a sonic mirror, reflecting sound substantially in only one direction rather than scattering it in a wide range of directions, as most objects do. Such reflection can occasionally cause standing water to reflect the ultrasound echo away from a sensing transducer. When this happens, the sensor momentarily fails to detect the water surface, which it had been detecting as an object, and instead it detects an object farther away. The system can interpret this change in detected the distance as motion, and unintended water flow can result.

SUMMARY OF THE INVENTION

The present invention employs the teachings of the Parsons patent in such a way as to reduce the likelihood that a motion-based flow control system will respond to motion indications caused by standing or splashing water. We have found that much of the undesirable splashing motion occurs near a sensed stationary object. The water surface in a coffee cup, for instance, is stationary, but the water can splash, and the splashing occurs near the surface of the filled cup.

In accordance without invention, therefore, the system computes an "average" value from a plurality of successive measurements made when an object does not cause the valve to open, i.e., when the object is substantially stationary. This average can be the basis on which to decide which of a plurality of different sets of criteria to use to determine whether the valve is to be open or closed. For instance, a single instance of more than a minimum motion amount may be the valve-opening criterion if the detected object is not close to the average position, while more-consistent motion may be required of objects detected near the average distance.

The average value can also be combined with a direction requirement to reduce the possibility of interpreting as motion the "disappearance" of a standing-water surface. Specifically, the system would typically employ a maximum-motion threshold such as 3 inches (7.6 cm.) in a 0.1-second sensing cycle; any motion greater than 3 inches is ignores as being invalid motion since the objects whose motion is intended to cause water flow are unlikely to move that fast. In the specific instance of apparent motion from the average distance to a location farther away, however, a more-stringent threshold of, say, 1.5 inches (3.8 cm.) is used so as to reduce the possibility that the system will respond to the intermittent detection of the water surface in a water-filled cup, which is typically between 1.5 inches and 3 inches in height. In this way, the occurrence of unintended valve operations can be reduced.

The invention is defined more precisely in the appended claims.

BRIEF DESCRIPTION OF THE DRAWINGS

These and further features and advantages of the present invention are described in connection with the accompanying drawings, in which:

FIG. 14 is a diagram of the signal sequence for the audible signal train; and FIGS. 15A and 15B are the waveforms used in the signal sequence of FIG. 14.

DETAILED DESCRIPTION OF AN ILLUSTRATIVE EMBODIMENT

Figure 1:
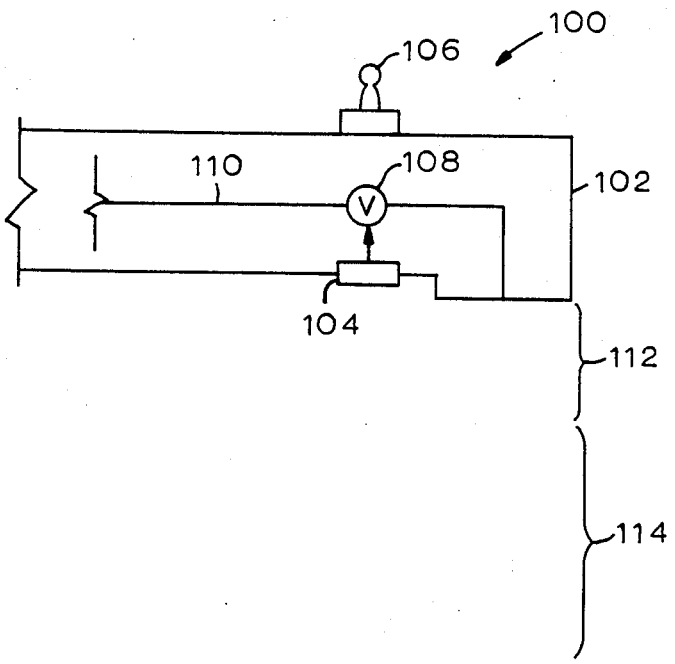
FIG. 1 is a somewhat schematic depiction of an automatic faucet that employes the teachings of the present invention.

FIG. 1 depicts an automatic faucet that embodies the teachings of the present invention. The system 100 includes a faucet 102 and a sensor system 104 for sensing the motion of objects below the faucet 102. A typical arrangement includes a switch 106 that the user operates to switch between automatic and manual operation. When the user chooses automatic operation, the faucet automatically allows water to flow when objects meeting certain criteria are present. When the user chooses manual operation, he must turn the faucet on and off manually.

Figure 2:
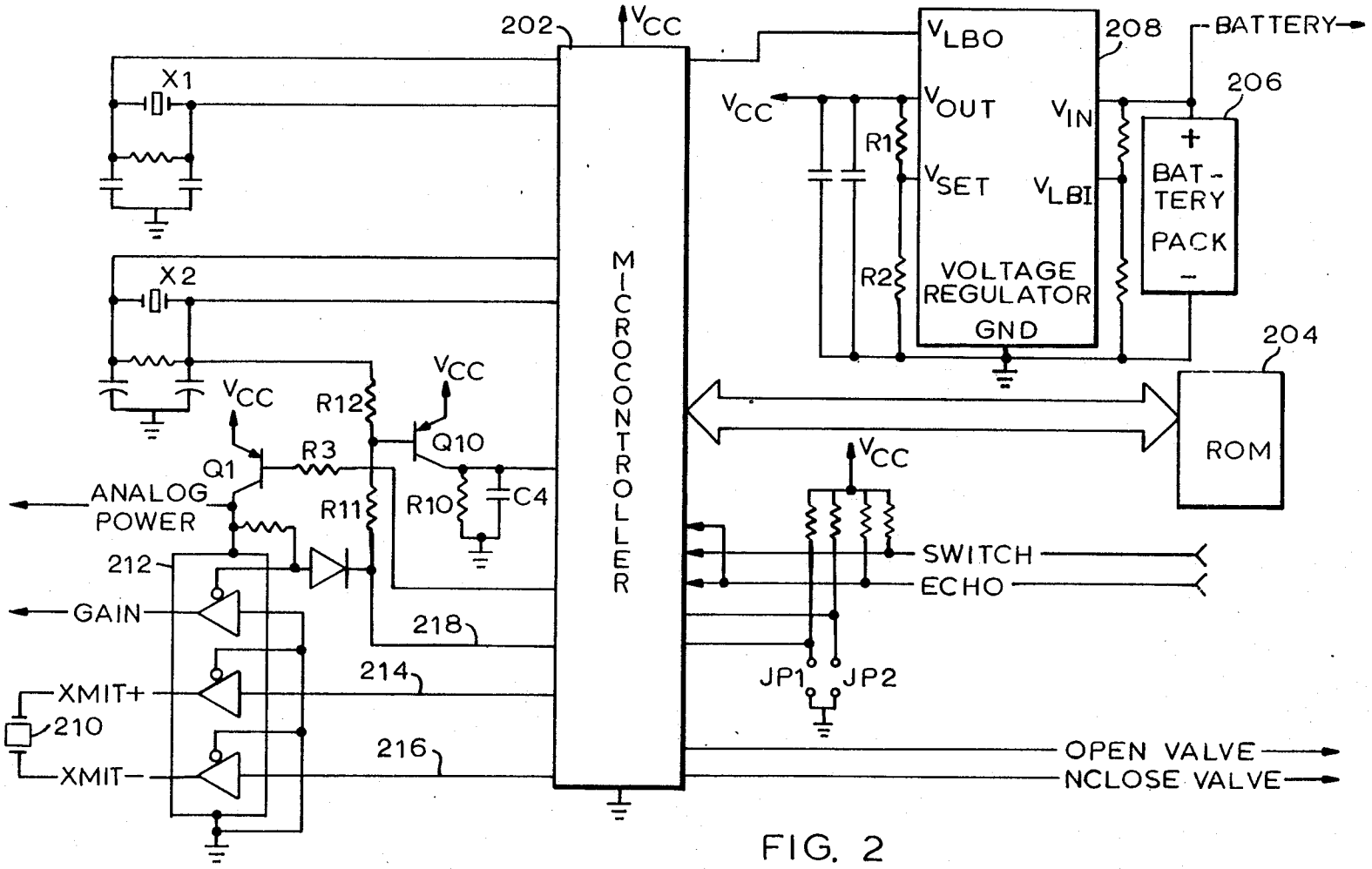
FIG. 2 is a schematic diagram of certain of the circuitry employed in the automatic faucet of FIG. 1.

FIG. 2 depicts the circuitry employed in one embodiment of the sensor system. This is a microprocessor-based system, but those skilled in the art will recognize that it can readily be implemented in random logic. The heart of the circuit is a Mitsubishi M50932 microcontroller 202, which is basically a combination of a microprocessor, some timers, and on-board memory. Although the specific microcontroller used in the illustrated embodiment includes both read/write memory (RAM) and read only memory (ROM) on board, we have chosen to use only the on-board read/write memory; we use a separate ROM 204 as our program memory. The ROM 204 is connected to the microcontroller 202 by the usual address, data, and control lines, whose functions are conventional and will not be described here in detail.

A series combination 206 of four 1.5-volt AA-size batteries provides power to the microprocessor 202, ROM 204, and other circuitry to be described below. A voltage regulator 208 receives the battery voltage across its $V_{in}$ and ground (GND) terminals and supplies regulated voltage across its $V_{out}$ and GND terminals, receiving feedback for the regulation process at its $V_{set}$ terminal from a voltage divider consisting of resistors R1 and R2. The voltage-regulator circuit 208 further includes a low voltage detector, which receives at its LBI (low battery input) terminal a divided version of the battery voltage. It compares this divided value with an internal reference and produces at its LBO (low battery output) terminal the binary result of this comparison.

The microcontroller 202 can choose between two clock speeds. The speed of its slow clock, which operates at 32.768 kHz in the illustrated embodiment, is set by an external crystal X1. A second external crystal X2 sets the 1.8-MHz speed of its fast clock.

In general, the circuitry of FIG. 2 performs three functions. The first is to cause an ultrasonic transducer 210 to transmit ultrasound into the region beneath the faucet 102 so as to cause objects in that region to produce echoes. The second is to analyze signals generated in response to those echoes by detection circuitry that will be described below in connection with FIG. 3. The third is to operate an electrically controlled valve 108 of FIG. 1 in accordance with that analysis. The valve 108 is shown schematically as controlling water flow through the schematically depicted conduit 110 within the faucet 102. The circuitry by which the microcontroller 202 controls the valve 108 will be described in connection with FIG. 4.

To conserve energy, the microcontroller 202 applies power to the transmission and reception circuits only while they are actually in use. Specifically, the microcontroller 202 controls a transistor Q1 by way of a connection through a resistor R3 to its base. Transistor Q1 receives the regulated voltage $V_{CC}$ from the voltage regulator and applies a resultant ANALOG POWER signal to the transmission and reception circuitry when microprocessor 202 turns that transistor on. When the microcontroller 202 turns transistor Q1 off, no current can flow through Q1 and the ANALOG POWER line to the transmission and reception circuits, so they do not draw power.

The transmission circuitry includes two drivers of a three-driver circuit 212, which receives its two transducer-controlling inputs on lines 214 and 216 from the microcontroller 202. To cause the transducer to transmit ultrasound, the microcontroller applies complementary input signals to the driver circuit 212, alternating the levels of those complementary signals at the intended ultrasonic frequency. The driver circuit 212 applies the resultant outputs to the transmitting transducer 210, which accordingly produces the desired ultrasound.

Figure 3:
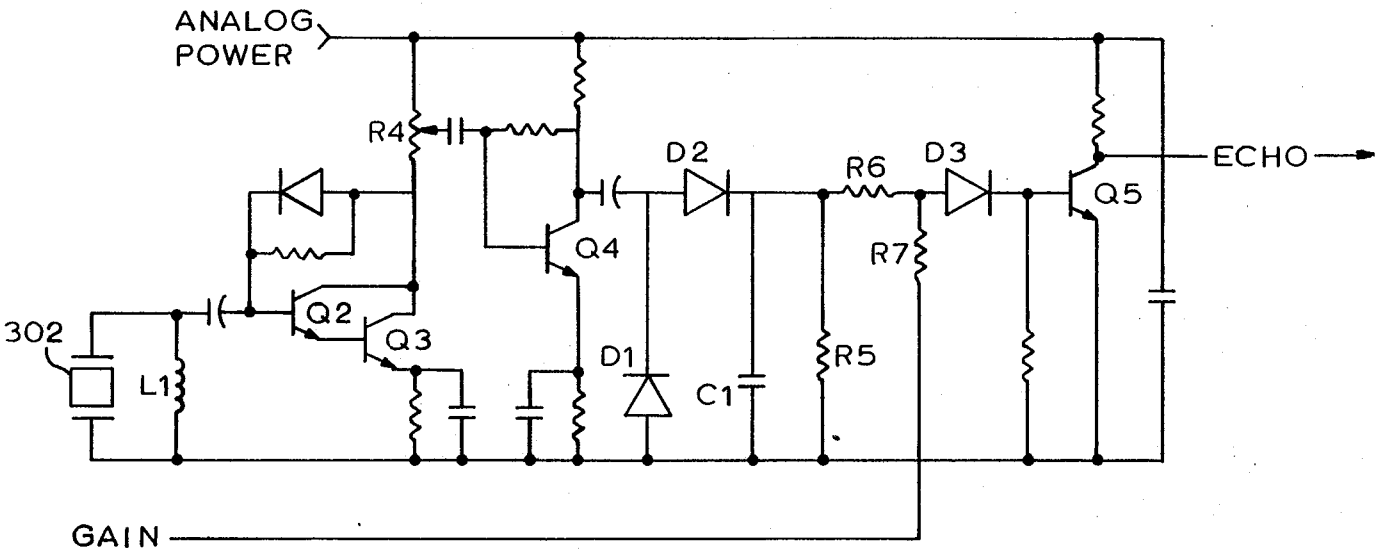
FIG. 3 is a schematic diagram of the echo-detection circuitry of the automatic faucet of FIG. 1.

FIG. 3 depicts a second ultrasonic transducer 302, which is used to sense the resultant echo An inductor L1 is connected across the output terminals of the reception transducer 302 to filter out the low-frequency noise typically produced by running water.

Subsequent circuitry in the signal chain that includes transistors Q2, Q3, and Q4 constitutes a conventional amplifier in which a potentiometer R4 is used to set the gain. Typically, the gain would be adjusted upward upon, for instance, the installation of a new battery until cross talk occurred between the transducers, and the gain would then be reduced from the cross-talk level by a predetermined amount. The potentiometer can be replaced with a resistor network and computer-controlled switches to enable the adjustment to be performed automatically. The amplifier supplies its AC output to a rectifier circuit comprising diodes D1 and D2, capacitor C1, and resistor R5, which together convert the amplified AC signal to a DC level proportional to the amplitude of the AC signal.

Resistors R6 and R7 constitute an additional network that forwards the rectified DC voltage with a gain determined by a GAIN signal. The GAIN signal results from a third driver in driver circuit 212 (FIG. 2) under the control of a signal that the microcontroller 202 places on line 218. Specifically, the third driver connects the lower side of R7 ground in one state and presents it with an open circuit to allow it to "float" in the other state. When the GAIN line is allowed to float, the rectified DC voltage is applied with relatively little attenuation to a threshold detector comprising diode D3, transistor Q5, and related circuitry. When the GAIN line is grounded, on the other hand, that voltage is divided by a voltage divider consisting of resistors R6 and R7. The microcontroller 202 uses the resultant ECHO signal to determine whether to operate the valve 108. The GAIN signal effectively acts as a threshold-setting signal to set the level that the rectified voltage must reach before the ECHO signal reaches its echo-indicating level.

Instead of the simple on-off gain function shown, it may be desirable for the microprocessor to operate a multiple-input resistor network for a finer threshold control. Such a network could be used for an initial automatic threshold calibration. Although we believe that such a feature is desirable, we have not yet implemented it.

Figure 4:
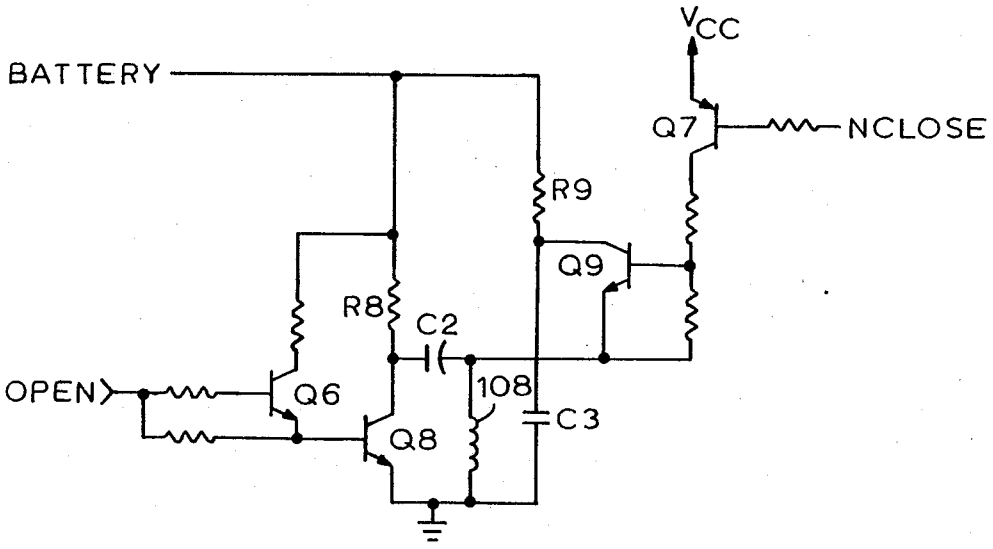
FIG. 4 is a schematic diagram of the valve-operating circuitry employed in the automatic faucet of FIG. 1.

The microprocessor operates the valve by means of circuitry depicted in FIG. 4. The valve 108 is a latching valve; i.e., it requires current to change state but not to remain in either state. A typical latching valve includes an operating member, a permanent magnet that tends to draw the operating member into its open state, and a spring that tends to bias the operating member toward its closed state A typical latching valve also includes a coil that can be driven in either direction to cause the resultant magnetic field to aid or oppose that of the permanent magnet and thereby open or close the valve.

In accordance with one aspect of the present invention, we employ a relatively short pulse of a relatively high current to open the valve, but we use a longer, lower-current pulse to close the valve. In opening the valve, the magnetic field generated by the coil operates to move the operating member closer to the permanent magnet, where the magnetic field is greater, so rapid reduction in the magnetic field applied by the coil is acceptable because the magnetic field experienced by the operating member increases as the operating member moves. What is important is that the field generated by the coil be high initially to get the operating member moving.

In closing the valve, on the other hand, the electrically generated field needs only to reduce the total field enough to allow the spring to overcome the total magnetic field, but it must generate this field over a relatively longer time because the spring force decreases as the operating member moves away from the permanent magnet.

The circuitry of FIG. 4 operates to provide pulses of the two different types to open and close the valve. In the illustrated embodiment, the valve coil 108 has a very low impedance, drawing considerably more current at normal circuit voltage levels than is available on an instantaneous basis from the batteries 206 and voltage regulator 208. Consequently, capacitors C2 and C3 store the energy necessary to operate the valve.

To keep the valve in its current state, the microcontroller 202 applies OPEN and NCLOSE signals to the circuit of FIG. 4 at low and high levels, respectively, so as to keep transistors Q6 and Q7 turned off. With these transistors turned off, two further transistors Q8 and Q9 are also turned off, so there are only two paths through the FIG. 4 circuit from the positive side of the battery combination 206 to ground.

The first path starts at the positive side of the battery and runs through resistor R8, capacitor C2, and the valve coil 108 to ground. Of course, capacitor C2 charges to the battery voltage, so current soon stops flowing through that path. The second path begins at the positive side of the battery and runs through another resistor R9 and capacitor C3 to ground. Like capacitor C2, capacitor C3 soon charges to the battery voltage, and current stops flowing in this path, too. Thus, both C2 and C3 are charged to the battery voltage at steady state.

To open the valve, the microprocessor applies a high OPEN signal to the circuit of FIG. 4, thereby turning on transistors Q6 and Q8 so that transistor Q8 connects the left side of capacitor C2 to ground. Consequently, the junction of capacitor C2 and the valve coil 108 falls to a voltage that is lower than ground by nearly the battery voltage. A large current consequently starts to flow through the valve coil 108. This current causes a high magnetic field that aids the field of the permanent magnet so as to overcome the spring force and cause the valve operating member to move toward the permanent magnet. Since the capacitor C2 discharges through the low impedances of the valve coil 108 and the saturated transistor Q8, it discharges quickly, and the current flowing through the coil is quickly reduced, thereby reducing the magnetic field that it produces. By this time, however, the valve operating member has moved close enough to the permanent magnet that the permanent-magnet field can pull the valve the rest of the way to its open position.

The microcontroller then changes the OPEN signal to its low level, turning off transistors Q6 and Q8. Current therefore flows through the path consisting of the valve coil 108, capacitor C2, and resistor R8 to restore capacitor C2 to its fully-charged condition. Although this restoration current flows through the valve coil 108 in the direction used to close the valve, resistor R8 limits this current to a level low enough that the valve remains open.

To close the valve, the microcontroller 202 impresses a low-level NCLOSE signal on the base of transistor Q7, thereby turning on transistors Q7 and Q9. Transistor Q9 thus connects the upper ends of the coil 108 and capacitor C3, thereby completing a discharge path for capacitor C3 through the valve coil 108. If the Q7–Q9 circuit were similar to the Q6–Q8 circuit, therefore, a high-amplitude, short-duration pulse in the opposite direction would result.

In contrast to transistor Q8, however, transistor Q9 is not permitted to assume its completely conducting condition, because the emitter of Q7 is connected to the regulator output $V_{cc}$ rather than to the higher battery output. If Q9 were completely conducting, its emitter would assume a voltage nearly as high as the battery voltage initially present across the capacitor C3. Transistor Q9 cannot be completely conducting, however, since its base voltage must remain somewhat below the lower $V_{cc}$ voltage, so such a high emitter voltage would turn Q9 off.

Transistor Q9 must therefore assume an intermediate state, in which it provides significant resistance to current flow. That is, transistor Q9 initially applies a lower fraction of the C3 voltage across the coil than transistor Q8 does of the C2 voltage. This slows the discharging of capacitor C3. The current amplitude during the closing operation is therefore lower than that during the opening operation, but it lasts for a longer time. This relatively long current pulse overcomes the magnetic field of the permanent magnet and permits the valve spring to move the valve operating member to the closed position.

The microcontroller then changes the NCLOSE signal to its high level, turning off transistors Q7 and Q9 and permitting capacitor C3 to recharge to the battery voltage.

The remainder of the description will present the ROM-204 program that controls operation of the microprocessor contained in microcontroller 202. According to the present invention, the program observes certain features of the detected object and uses these to select from different sets of criteria for determining whether to open or close the valve. The features are such that the resulting criterion choice reduces the likelihood that the valve will open or remain open in response to motions, such those of standing or dripping water, that are not intended to cause water flow.

The program also minimizes energy consumption by operating in active and passive modes. When the user initially chooses automatic operation, the system assumes an active mode, in which it performs a sensing operation once every tenth of a second. In the absence of an actual valve operation, the sensing function is the part of the operation cycle that takes the most power. To reduce energy consumption, therefore, the microprocessor switches from the active mode to a passive mode if 30 seconds pass without any motion of the type that could cause the valve to open.

In the passive mode, sensing usually occurs at 0.4-second intervals rather than at the 0.1-second intervals of the active mode. The passive mode differs from the active mode additionally in that the system "ignores" any object outside a close zone 112 (FIG. 1) when it is in the passive mode, while it takes into account objects occurring in both the close zone 112 and a far zone 114 when it is in the active mode.

Figure 5A:
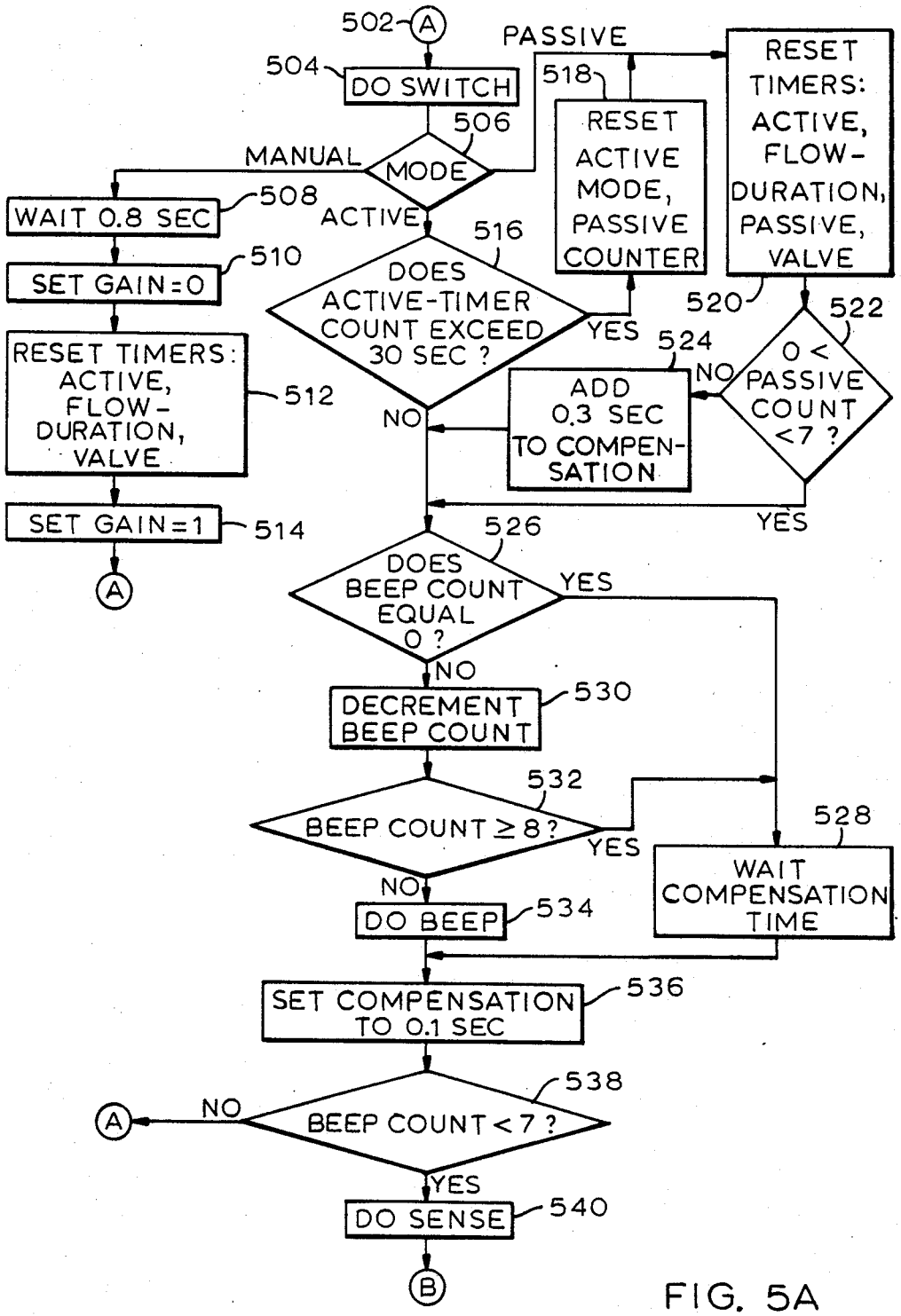
FIGS. 5A and 5B together are a flow chart of the main program loop executed by the microcontroller of FIG. 4.
Figure 5B:
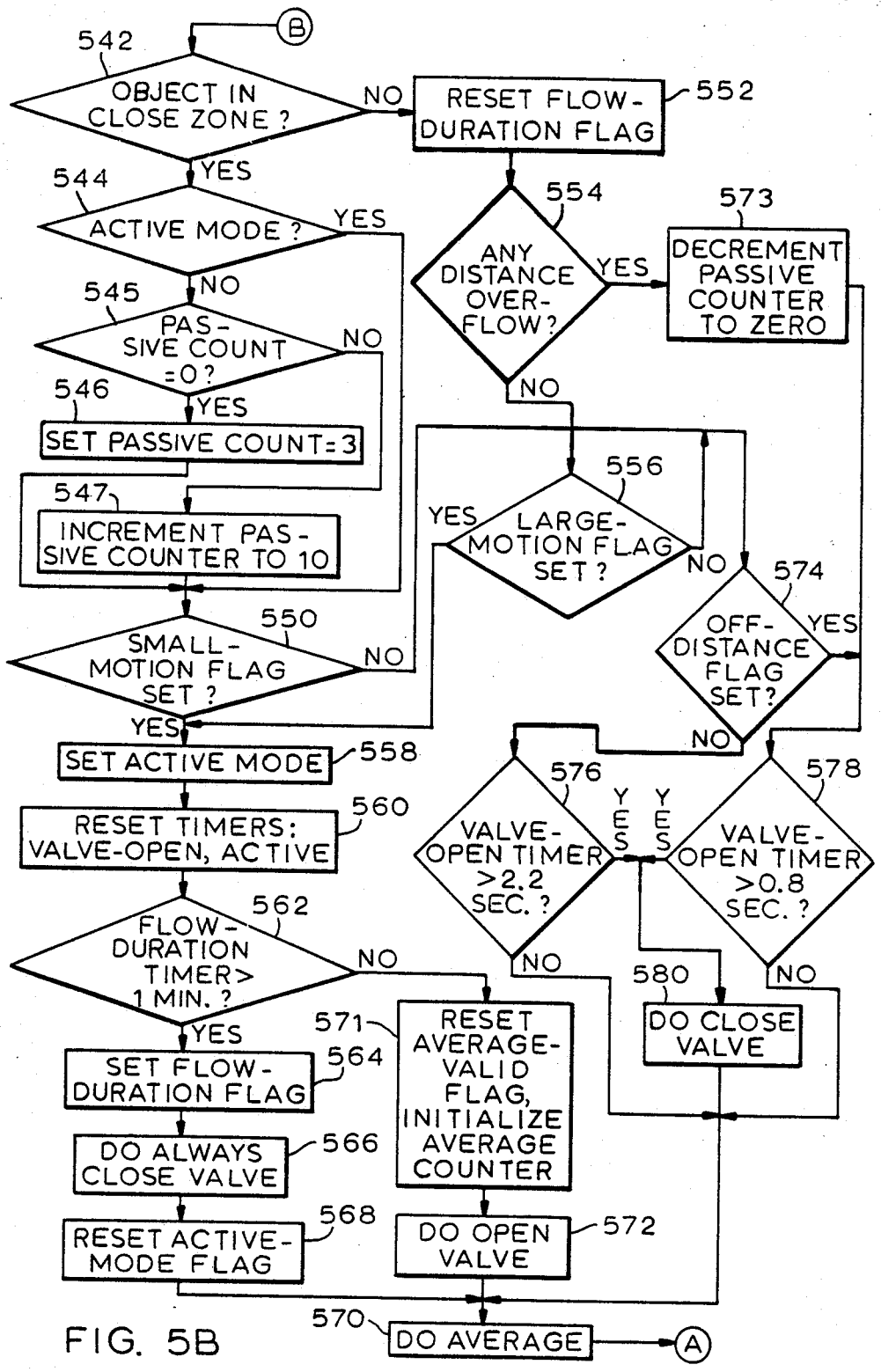

FIGS. 5A and 5B together depict the main loop of the program, and block 502 represents the loop's point of return from various other points in the loop The first step, represented by block 504, is execution of a switch routine. The switch routine, which will be described in more detail in connection with FIG. 11, interrogates the state of the switch 106 to determine whether the user has requested manual or automatic operation.

Block 506 represents the next step, which is a three-way branching operation. The routine follows one branch if the user has choosen manual operation. If he has chosen automatic operation, the routine takes a second or third branch in accordance with whether the system is operating in its active mode or its passive mode.

If the user has chosen manual operation, the microprocessor starts a timer, as block 508 indicates, and then stops operation. At the end of 0.8 second, the timer causes the microprocessor to resume operation.

The purpose of the block-510 step is to prevent failsafe circuitry in FIG. 2 from resetting the microcontroller in response to the absence of sensing operations. As was stated above in connection with FIG. 4, the GAIN signal determines whether the rectified signal from the receiving transducer 302 will be voltage divided before being compared with the threshold that determines whether the ECHO signal is to have a high value or a low value. Before the transmitting transducer 210 is operated to transmit ultrasound, the microcontroller switches the GAIN line to its grounded state, and it allows it to float after the driving of transducer 210 and its subsequent ringing have ended. The failsafe circuitry uses the microprocessor signal that controls the GAIN state as an indication that a sensing operation is occurring. The absence of a sensing operation for more than the duration of a few main-loop cycles is taken as a sign that something has gone wrong, and the failsafe circuitry resets the microcontroller 202 in an attempt to recover.

Specifically, the failsafe circuitry includes transistor Q10 (FIG. 2), which gates current from the $V_{cc}$ line to an RC circuit consisting of resistor R10 and capacitor C4. The base of transistor Q10 is connected through resistor R11 to the line 218 by which the microcontroller 202 controls the GAIN signal. It is also connected to the fast-clock circuit through another resistor R12. When the fast clock is not operating and the signal on line 218 is high—to allow the GAIN line to float as it does when transducer 210 is not being driven—Q10 is turned off and therefore does not charge up capacitor C4. The voltage across that capacitor is coupled to the microcontroller's reset terminal and resets the microcontroller to an initialized state whenever the capacitor voltage falls below the predetermined threshold. Consequently, if the GAIN-controlling signal on line 218 remains high continuously for a few seconds, and the fast clock does not operate during that time, the capacitor C4 discharges below the threshold and the resets the microprocessor. When the microprocessor is reset, it operates the fast clock momentarily, and this turns on transistor Q10, which accordingly charges capacitor C4 enough to allow the microprocessor to resume operation.

As was stated above, no sensing occurs during manual operation, so the step represented by block 510 occurs during manual operation to turn transistor Q10 on momentarily and thereby keep the microcontroller from resetting. The next step, represented by block 512, is to reset certain timers whose functions will be described below. These timers are internal to the microcontroller 202, as are all timers in the illustrated embodiment. In the time taken by the routine to reset the timers, capacitor C4 (FIG. 2) charges up enough to prevent the microcontroller from being reset. The microcontroller then sets the GAIN controlling signal on line 218 back to its high value, as block 514 indicates, and the loop repeats.

If the determination made by step 506 is that the system is in the active mode, the microprocessor interrogates a timer known as the active timer, which keeps track of how long the system has been in the active mode without having encountered enough motion to cause the valve to open. Block 516 represents this determination. If the active-timer output exceeds 30 seconds, the microprocessor resets the flag that indicates that the system is in the active mode, and it thereby assumes its passive mode. Block 518 represents this step as well as that of resetting a passive counter, whose purpose will be described below.

If the routine branches to block 518, it completes the steps represented by that block and then continues as though the block-506 determination had been that the system was in the passive mode. In accordance with that determination, the microprocessor resets several timers in a step represented by block 520. Specifically, it resets the active timer, whose function was just described. It also resets the flow-duration timer, which indicates how long water has been continuously commanded to flow.

As will be explained later, the system includes a safety feature according to which the water is turned off if motion has been detected consistently for more than a maximum duration, such as one minute. A flow duration timer is used to measure the duration of such motion detection, and it is set to zero in the block-520 step. The flow-duration timer must be reset during every passive-mode loop in order to prevent it from reaching its overflow value.

Block 520 also represents resetting a valve timer. The valve timer measures the time since the valve was last ordered to open—or since it would have been ordered to open if it had not already been open. As will be explained later, motion that meets the criteria for opening a valve will cause the valve to open, and the valve will remain open in subsequent cycles even in the absence of such motion until the valve timer indicates that the valve has been open for a predetermined minimum time since detection of the last motion meeting the valve-opening criteria. In other words, motion must be absent for a predetermined duration before the valve closes.

The next step, represented by block 522, is part of the implementation of a feature by which the system responds relatively quickly to motions that occur while the system is in the passive mode, in which it ordinarily performs sensing cycles at the relatively low rate of once every 0.4 second. As was stated above, the system enters the passive mode when no motion of the required type has occurred for a predetermined length of time. Additionally, the system responds in the passive mode to motion of only those objects that are located in a relatively close zone. Consequently, when the system is in the passive mode, it ordinarily is detecting no objects at all.

When it initially does detect an object, however, it is desirable for the system to respond quickly if that object exhibits motion that meets the valve-opening criteria. Accordingly, if the system suddenly detects an object after a period during which it has detected none, it will temporarily increase the speed with which it produces sensing cycles. Specifically, the period between cycles will revert to 0.1 second if the output of the passive counter is greater than zero but less than seven, i.e., if an object is indeed present but has been present for less than seven cycles without exhibiting enough motion to cause a change to the active mode.

If the passive-counter output is not between zero and seven, the microprocessor adds to a compensation-time register a value representing an additional 0.3 second of delay, as block 524 indicates. The compensation time register ordinarily has a value representing 0.1 second, which is the delay imposed by the microprocessor between sensing cycles when the system is in the active mode. In the passive mode, the imposed delay is 0.4 second, so the compensation time is ordinarily increased by 0.3 second. On the other hand, if the passive counter output is between zero and seven, the additional compensation time is not added, and the delay is only 0.1 second even though the system is in the passive mode.

During automatic operation, the system operates transducer 210 to produce an audible signal under certain circumstances when the batteries are low. An internal beep counter indicates whether the beep signal should be produced, and block 526 represents the interrogation of this counter. If the counter output is not a value from one to nine, the beep-generating routine is bypassed, and the system pauses for a time interval equal in duration to the compensation time. Otherwise, the beep routine is executed without separately pausing for the compensation time, since the beep routine itself consumes significant time. Moreover, the beep counter is decremented whenever its output is greater than zero. Blocks 528–34 represent these operations, whose purposes will be explained in more detail in connection with FIG. 13.

Block 536 represents the step of resetting the compensation register to a value that represents 0.1 second., for the ordinary passive mode, it will have been changed to 0.4 second, and it must be returned to its original value before the next cycle through the main loop.

If the beep count is less than seven, the beep operation has been completed. As block 538 indicates, therefore, the microprocessor then determines whether the beep count has reached a value below seven. If it has, the microprocessor returns to the beginning of the main loop. Otherwise, it executes a sense routine, as block 540 indicates.

The sense routine, which will be described below in connection with FIG. 6, causes transducer 210 to transmit ultrasound and monitors the signal produced by transducer 302 in response to any resultant echoes. It also measures the time delay between ultrasound transmission and reception and thereby determines the positions of objects that cause the echoes. The sense routine also calls a motion routine, which determines whether such objects exhibit motion that meets certain of the latch-opening criteria.

As a result of the sense routine, the system will have determined whether a detected object is in the close zone 112 (FIG. 1). Block 542 (FIG. 5B) represents branching on this determination. If the system is in the passive mode, presence of an object in the close zone may cause the system temporarily to increase the rate at which the sense operations are performed, as was explained above.

Blocks 544, 545, 546 and 547 represent determining whether the system is in the passive mode and, if it is, incrementing the passive counter if that counter has not yet reached a count of ten. That is, the output of the passive counter increases when the system detects an object in the passive mode (and, as will be explained below, decreases when it does not). It will be recalled that the passive counter is the one that causes sensing at a rapid rate if its output is between zero and seven. If the passive count had been zero, the result of the block-545 determination is positive, and the passive counter is incremented by three instead of one. The reason for this is that the first detection of an object in the close zone is very often followed by a failure to detect it even though the object is actually entering the close zone. Initially, incrementing the passive counter to three gives the system a second and third chance to detect the object while the sensing operations are still being performed rapidly.

The routine then performs the step represented by block 550, which is to branch on the determination of whether there has been more than one unit of motion; that is, it branches on whether the previous distance measurement differs from the current distance measurement by more than one. In the illustrated embodiment, one unit represents a distance of 0.06 inch (0.15 centimeter). In the close zone, this is the minimum motion required to cause the valve to open.

If no object is in the close zone, the routine branches at block 542 to the step represented by block 552, in which a flow-duration flag is reset. This is a flag that is set when the flow-duration timer reaches the time limit for consistent motion detection. Although the flow-duration timer is reset during every passive-mode main loop in the step presented by block 520, the flow-duration flag is not, and the flag prevents the valve from opening until it is reset. The typical reason for consistent motion detection that exceeds the maximum duration is a dish rag draped over the faucet. Resetting the flow-duration flag only when no object is in the close zone forces the user to remove the dish rag so that the system can operate in the desired manner.

If the system detects an echo within a time period representing the maximum range—e.g., 2½ inches (6.3 centimeter ) in the passive mode and 10 inches (25 centimeters) in the active mode—then the determination of step 554 is negative, and the microprocessor branches to a section of the main loop in which the valve may be opened. In the passive mode, however, the step 554 determination is always positive, because the program reaches step 554 only if no object is in the close zone, and the distance timer is set to overflow at the end of the close zone in the passive mode. The program thus reaches block 556 only if the system is in the active mode. Block 556 imposes the minimum-motion criteria in the far zone. It is similar to the test of the close zone represented by block 550, but it requires four units of motion rather than the one unit required by block 550. In other words, among the criteria for opening the valve is that the motion be greater than one unit in the close zone and greater than four units in the far zone.

If either of these criteria is met, the microprocessor proceeds to the step represented by block 558, in which, if the system had previously been in the passive mode, it sets the active-mode flag because enough motion has been detected to convert back to the active mode. The valve-open and active timers are then reset, as blocks 558 and 560 indicate.

The valve-open timer is different from the flow-duration timer. As was stated above, the flow-duration timer counts the length of time for which enough motion to keep the valve open has consistently been detected. The valve-open timer, on the other hand, indicates how long it is has been since the last time enough motion occurred to justify opening the valve or keeping it open. Its output is used to insure that the valve remains open for at least a minimum length of time after motion meeting the valve-opening criteria has occurred. This feature conserves energy and avoids annoying valve chatter, and it results in performance more in accord with the user's expectations because it avoids flow interruptions resulting from intermittent, very-short-term absences of motion.

The active timer is the timer consulted in block 516 to determine whether to switch from the active mode to the passive mode. Since the purpose of the active timer is to measure how long the system has been in the active mode without having detected enough motion to justify opening the valve, the active timer is reset in the step represented by block 560 because enough motion to justify opening the valve has just been detected when the microprocessor reaches that step.

After the timers have been reset, the microprocessor proceeds to the step represented by block 562, which implements a safety feature. In actual operation, even when water is flowing and dishes or hands are being washed, motion is absent more than ten percent of the time. If motion detection is consistent for one minute, therefore, the system assumes that a failure or error condition has occurred, and it turns the water off.

Specifically, in block 562, the microprocessor checks the flow-duration timer to determine whether an object has, for more than a minute, consistently exhibited enough motion to justify keeping the valve open. If so, it sets the flow-duration flag to indicate this condition, calls a subroutine to close the valve, and resets the active-mode flag to switch the system to the passive mode. Blocks 564, 566, and 568 represent these steps. The routine then calls an average-distance-computing routine, as block 570 indicates, for purposes that will be described below, and the microprocessor returns to the main loop.

On the other hand, if the determination in the block-562 step is that the output of the flow-duration timer does not represent a duration greater than a minute, the microprocessor proceeds to the step represented by block 571, in which a flag is reset to indicate that an average-distance quantity, whose purpose will be described below, is invalid. The average distance is computed over a number of cycles counted by an average counter, which the microprocessor also sets to zero. The reasons for this resetting step will be discussed below in connection with FIG. 8.

As block 572 indicates, the main loop then calls the valve-opening subroutine to open the valve. When that subroutine has been completed, the microprocessor returns to the beginning of the main loop after performing the average subroutine.

If the result of the determination represented by block 554 was that no object was detected within the maximum range, the microprocessor decrements the passive counter if the output of that counter has not yet reached zero, as block 573 indicates. This step and the steps represented by blocks 518, 522, and 546 constitute the part of the main loop that enables the system to increase the sensing rate in the passive mode when an object is first detected but to decrease the rate again if the sensed object proves not to exhibit motion that meets the valve-opening criteria.

In the passive mode, the output of the passive counter is initially zero before an object is detected in the close zone (which is the only zone inspected in the passive mode). This results from the counter's having been reset when the system converted to the passive mode in the step represented by block 518. Accordingly, when the microprocessor tests the output of the passive counter in block 522, it branches to the step represented by block 524, in which 0.3 second is added to the compensation time so that the normal 0.4-second passive-mode compensation time results. Therefore, so long as the system detects no object, the output of the passive counter remains zero.

But when the steps represented by blocks 542 and 544 result in a determination that an object has been detected in the close zone while the system is in its passive mode, the microprocessor increments the passive counter, as blocks 546 and 547 indicate. If the count had been zero, the count is set to three. If the object has not exhibited enough motion to result in entry into the active mode, the loop repeats in the passive mode, but this time the test represented by block 522 indicates that the passive counter is between zero and seven, so the extra 0.3 second is not added to the compensation time. Therefore, the microprocessor imposes only a 0.1 second wait before the next sensing operation; i.e., the sensing rate increases. If the next sensing operation again finds an object in the close zone, the passive counter is again incremented, so its output increases to four. On a subsequent loop, the passive counter is again between the values of zero and seven, and again only a 0.1-second wait is imposed before the next sensing operation.

So long as the detected object remains in a close zone and does not exhibit the requisite motion, the passive counter is incremented on each pass through the loop, and, although the system is in its passive mode, it senses at the rate characteristic of the active mode until the passive counter reaches a count of seven. When the output of the passive counter reaches seven, the result of the test represented by block 522 is that the output of the passive counter is not between the values of zero and seven. The step represented by block 524 therefore results in addition of 0.3 second to the compensation time so that 0.4 second is interposed between sensing cycles. This 0.4-second period then prevails on subsequent cycles, and the passive counter is incremented on subsequent cycles until it reaches a count of ten, at which it remains so long as an object remains in the close zone and does not exhibit the requisite motion.

If the object disappears from the close zone, however, the step represented by block 542 results in branching in a different direction so that, after the flag resetting represented by block 552, the routine proceeds to the step represented by block 573, in which the passive counter is decremented. (In the passive mode, the result of the test represented by block 554 is always affirmative, but the test is necessary because the active mode also employs that segment of the routine.) If the close zone remains vacant for ten loops, the passive-counter output returns to a count of zero, and the system is again set to respond rapidly to a new object.

If the motion of the object is less than the lower motion threshold in the close zone or less than the higher motion threshold in the far zone—that is, if the result of the test represented by block 550 or 556 is negative—the microprocessor proceeds to the step represented by block 574, which is involved in implementing the feature by which the water stops flowing sooner when an object disappears entirely than when the object is present but not moving. This is a human-factors feature; if the object has stopped only momentarily, it is quite likely that the user wants the water to keep flowing and will shortly resume motion. If the object is removed entirely, on the other hand, it is less likely that the user wants the water to keep running, and a quick response is preferable.

Therefore, the step represented by block 574 represents branching on a flag that contains the results of a test, performed during the sensing subroutine, in which that subroutine determines whether an object is located within a predetermined off distance. This off distance is not the maximum active-mode range, which is typically 10 inches (25 centimeters), but rather a shorter distance, say, 7.5 inches (19 centimeters) for a kitchen-sink model. We use the shorter distance because an object positioned beyond that range is more likely to be a stationary object in the sink bottom, and the response should not be slowed for such an object.

Either result of the test represented by block 574 is a test of the valve-open timer, which indicates how long it has been since the last motion that was sufficient to justify opening the valve. If it was determined that an object is present within the off distance, that timer is tested for an output greater than 2.2 seconds, as block 576 indicates, while it is tested for an output greater than 0.8 second, as block 578 indicates, if no object is present within that distance. In both cases, the valve must have been open for the required time before it is allowed to close. If the respective duration requirement has been met, the main loop calls a valve-closing subroutine, as block 580 indicates, and then returns to the beginning of the main loop after performing the average subroutine represented by block 570. Otherwise, the routine goes directly to the average subroutine without opening the valve.

Figure 6A:
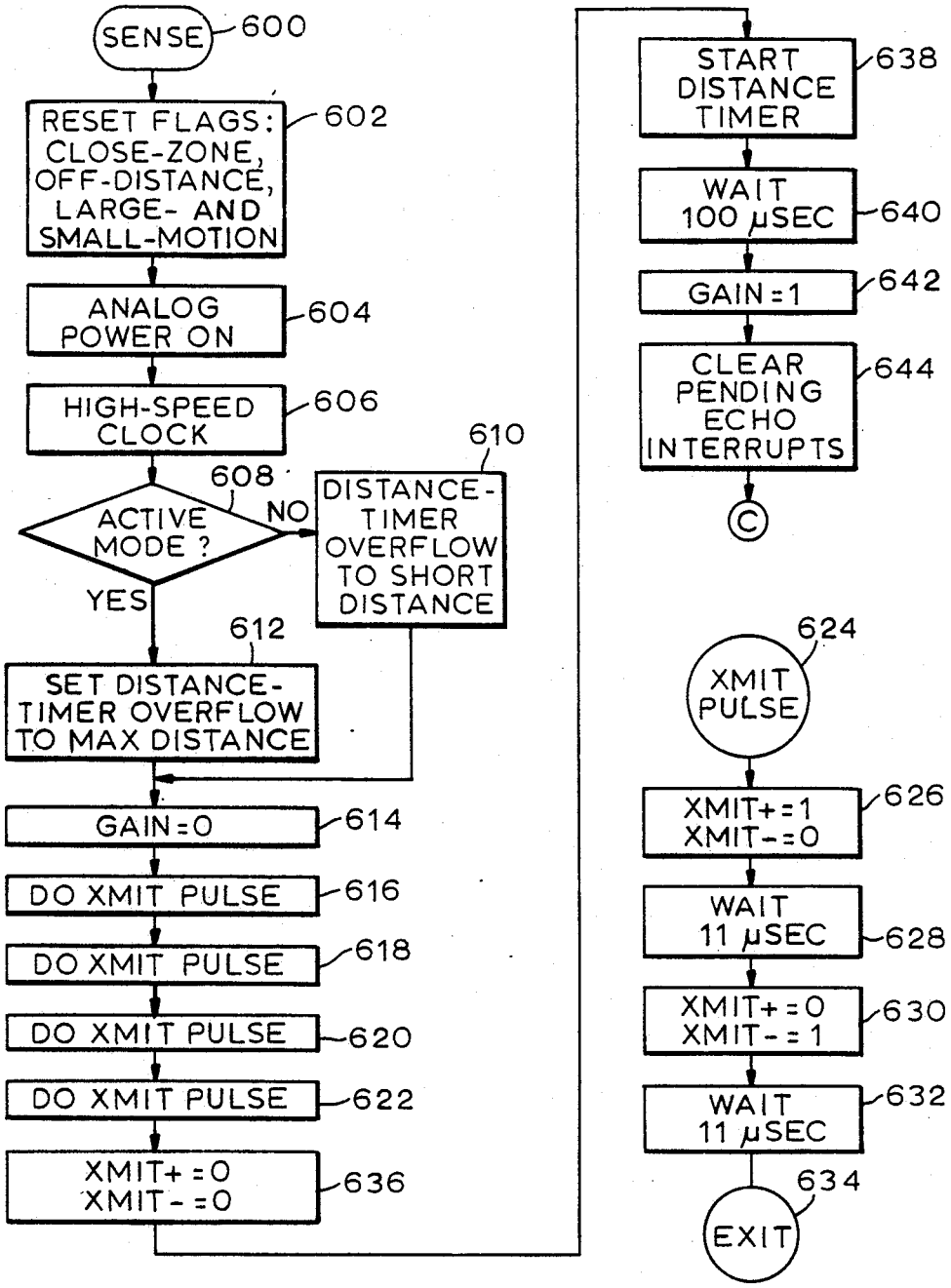
FIGS. 6A and 6B together are a block diagram of its sensing subroutine.
Figure 6B:
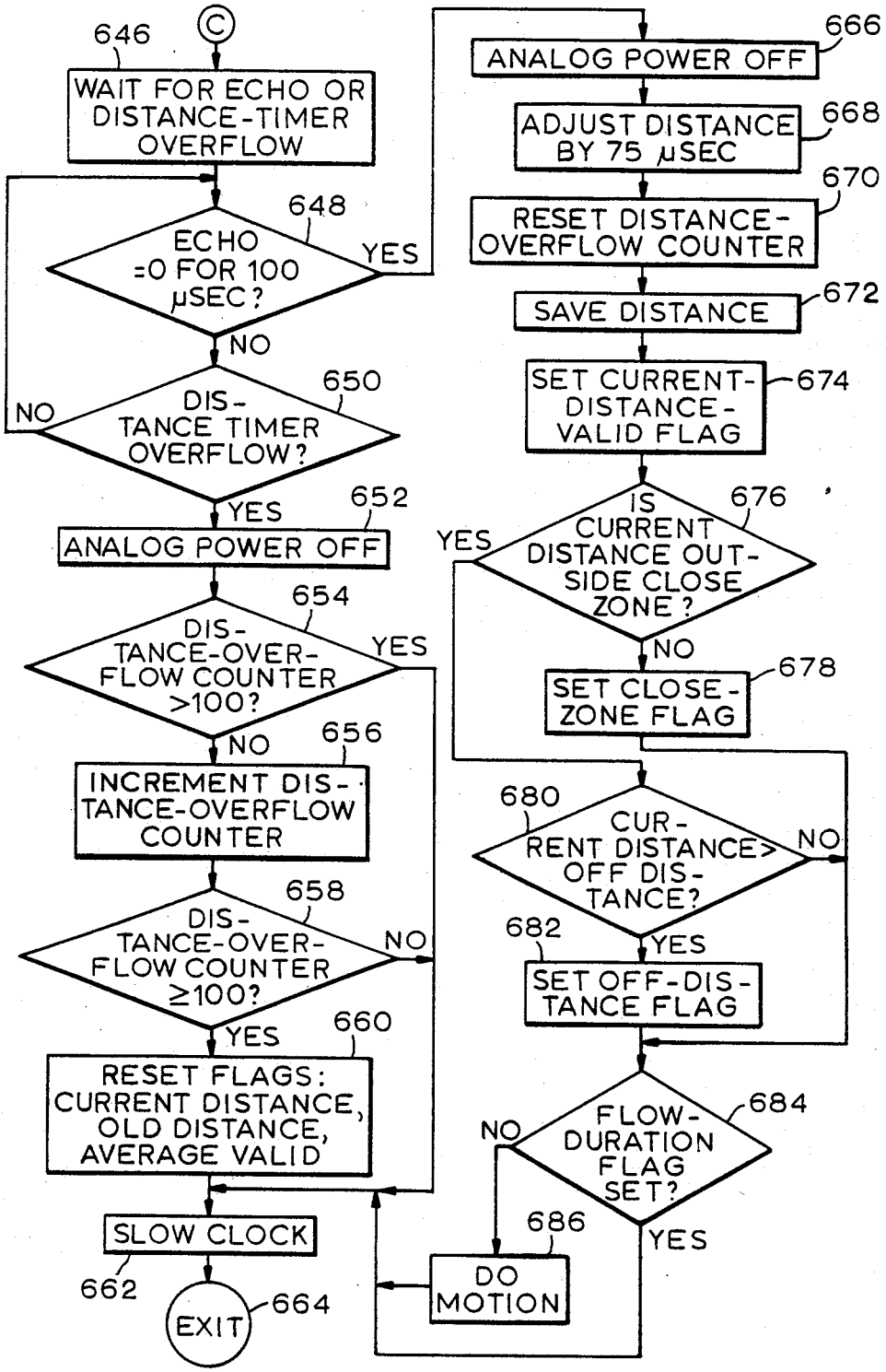

FIGS. 6A and 6B depict the sensing routine. In accordance with this routine, the control circuitry transmits a burst of ultrasound and monitors the reception-transducer output to detect any resultant echo. Block 600 represents entry into the routine. The routine first sets the close-zone flag, the off distance flag, and the motion flags, as block 602 indicates. The microcontroller then switches on the analog power, as block 604 indicates, by turning on transistor Q1 so that power is applied to the transducers, their drivers, and their amplifiers. The microprocessor then switches to the high-speed clock so that it can perform the sensing functions in real time. At other times, it uses the low-speed clock so as to conserve energy.

After the change in clock speed, which is represented by block 606, the microprocessor determines whether the system is in the active mode o the passive mode, as block 608 indicates. A distance timer is used to determine when the circuitry should stop "listening" for an echo. In the passive mode, this time is relatively short, representing only the close zone 112 (FIG. 1). Block 610 represents setting the initial distance-timer setting to the short distance when the system is in the passive mode, while block 612 represents setting the distance timer to the longer distance.

During pulse transmission, the reception circuitry should be set to a low gain (i.e., a high threshold) to keep it from responding to the high-magnitude transmitted ultrasound signal. Block 614 represents this step. After the gain has been set to its low value—which results in a high threshold—the microprocessor executes a transmit-pulse routine four times in a row, as blocks 616, 618, 620, and 622 indicate. In the transmit-pulse routine, whose entry is represented by block 624, the microprocessor operates internal latches that ultimately set the XMIT+ and XMIT− signals to one and zero levels, respectively, as block 626 indicates. The routine then observes a waiting period of 11 microseconds, as block 628 indicates, after which it reverses the values of XMIT+ and XMIT−, as block 630 indicates. Block 632 represents another 11-microsecond interval, and block 634 represents the return from the transmit-pulse subroutine. Since this subroutine is called four times in a row, the signal represented by XMIT+ and XMIT− reverses eight times with a two-reversal period of 22 microseconds to yield a frequency of approximately 45 kHz. The signal represented by XMIT+ and XMIT− is the signal applied to the transducer, so the transducer emits a four-cycle 45 kHz burst. At the end of this burst, the microprocessor sets XMIT+ and XMIT− both to zero, as block 636 indicates, so as to set the potential difference across the transducer to zero.

The distance timer, whose initial value was set in block 610 or 612, then begins counting down, as block 638 indicates. The microprocessor thereupon imposes a delay of 100 microseconds, as block 640 indicates, so as to allow transducer ringing to decay, and it sets the receiver gain to its high value in the step represented by block 642.

Even though the gain was previously at its low value, noise generated during transmission could still have caused the ECHO signal be asserted, and assertion of the ECHO signal sets an interrupt flag. Since an interrupt requested during transmission does not represent any valid object detection, the microprocessor clears any pending echo interrupts, as block 644 indicates, when transmission has been completed, and it then waits for further interrupts caused by the ECHO signal. Block 646 (FIG. 6B) represents the waiting state, which typically is implemented as a no operation loop that can be interrupted either by the echo interrupt or by a distance-timer overflow. That is, the routine leaves the no operation loop represented by block 646 as soon as an echo is detected or, if no echo is detected, after the period set in step 610 or 612.

To ensure that the echo interrupt is not the result of a "glitch," the microprocessor monitors the ECHO line to determine whether its assertion has lasted 100 microseconds. Block 648 represents this test. If the echo line has not been asserted for that long, the microprocessor checks the distance timer to see whether it has yet overflowed, as block 650 indicates. If so, any further echo will be caused by objects beyond the maximum range. If the deadline timer has not overflowed, the microprocessor loops back to the block 648 step, and this loop repeats until either (1) the ECHO line has been asserted continuously for 100 microseconds or (2) the distance timer finally overflows. When the distance timer overflows, the microprocessor turns off the analog power previously applied to the transducer and its drivers and amplifiers, as block 652 indicates.

At this point, the system has transmitted a pulse but has received no echo. The system operates by detecting differences between successive sensed distances, but if the next transmitted burst results in a valid echo, the distance represented by that echo cannot be compared with a distance as a result of the current pulse, since that pulse has resulted in no valid echo. Instead, the next valid measurement is compared with the distance determined in the last cycle that produced a valid echo. However, if the last valid echo occurred too long ago, it is not desirable to use the distance indicated by that echo for a motion determination. Accordingly, a distance-overflow counter keeps track of how many times in a row no valid echo occurred, and blocks 654, 656, 658, and 660 represent steps for maintaining the count and preventing a comparison if the counter output is too high.

Specifically, step 654 tests the distance-overflow counter to determine whether its output exceeds one hundred (about 10 seconds). If not, i.e., if the distance-overflow counter has not overflowed more than one hundred times, that counter is incremented, as block 656 indicates, and the result is tested, as block 658 indicates, to determine whether the result is greater than or equal to one hundred. If incrementing that counter has caused it to reach one hundred, the microprocessor resets flags, as block 660 indicates, to indicate that the "current distance," (the distance currently in a distance counter to be described below) is invalid, as is the "old distance," which is the distance recorded on the last valid echo. Block 660 further represents resetting an average valid flag to indicate that an "average distance" quantity, which will be described below, is invalid.

On the other hand, if incrementing the distance-overflow counter did not result in its reaching one hundred, the microprocessor skips step 660. In either event, the routine proceeds to a step represented by block 662, in which the microprocessor switches to its slow clock so that the system consumes less power while it is not actually sensing. As block 664 indicates, the microprocessor then returns to the main loop.

If a valid echo was detected in the step represented by block 648, the analog power is again turned off, as block 666 indicates, and the contents of the distance timer are adjusted for software delay so that they indicate the distance to the object that caused the detected echo. Block 668 represents this step. Since the system has received a valid echo, it resets the distance overflow counter, which counts how many times in a row the system failed to receive a valid echo. Block 670 represents this step. The microprocessor then stores the adjusted distance measurement in a current-distance register and sets its current-distance-valid flag, as blocks 672 and 674 indicate.

In the step represented by block 676, the microprocessor compares the distance stored in the distance register with a predetermined threshold value that represents the maximum extent of the predetermined close region 112. If the stored distance is less than the threshold, the microprocessor sets a close zone flag, as block 678 indicates. If the detected object is not in the close zone, on the other hand, the microprocessor compares the measured distance, as block 680 indicates, with an "off distance," which, as was mentioned before in connection with block 574, is typically somewhat less than the maximum distance at which an object can be located and still cause the water to turn on in accordance with the system criteria. If the object is located at a distance greater then this maximum distance, the microprocessor sets an off-distance flag, as block 682 indicates. The state of this flag determines how long the requisite motion must be absent before the valve is closed.

Regardless of the location of the sensed object, the microprocessor then advances to a step represented by block 684, in which it checks the contents of the flow-duration flag. This is a flag set in the main loop of FIG. 3 to indicate whether the requisite flow has consistently been detected for too long. Continuing flow for more than, say, one minute is taken as an indication that something is wrong. If this flag has not been set, the microprocessor proceeds to the motion routine of FIG. 5, as block 686 indicates, and that routine may result in setting motion flags that will be consulted during the main loop to determine whether the valve should be open. If the flow duration flag has been set, the microprocessor bypasses the motion routine and thereby prevents the setting of the motion flags that would cause the valve to remain open. In either case, the microprocessor switches to its slow clock and returns to the main loop, as blocks 662 and 664 indicate.

Figure 7A:
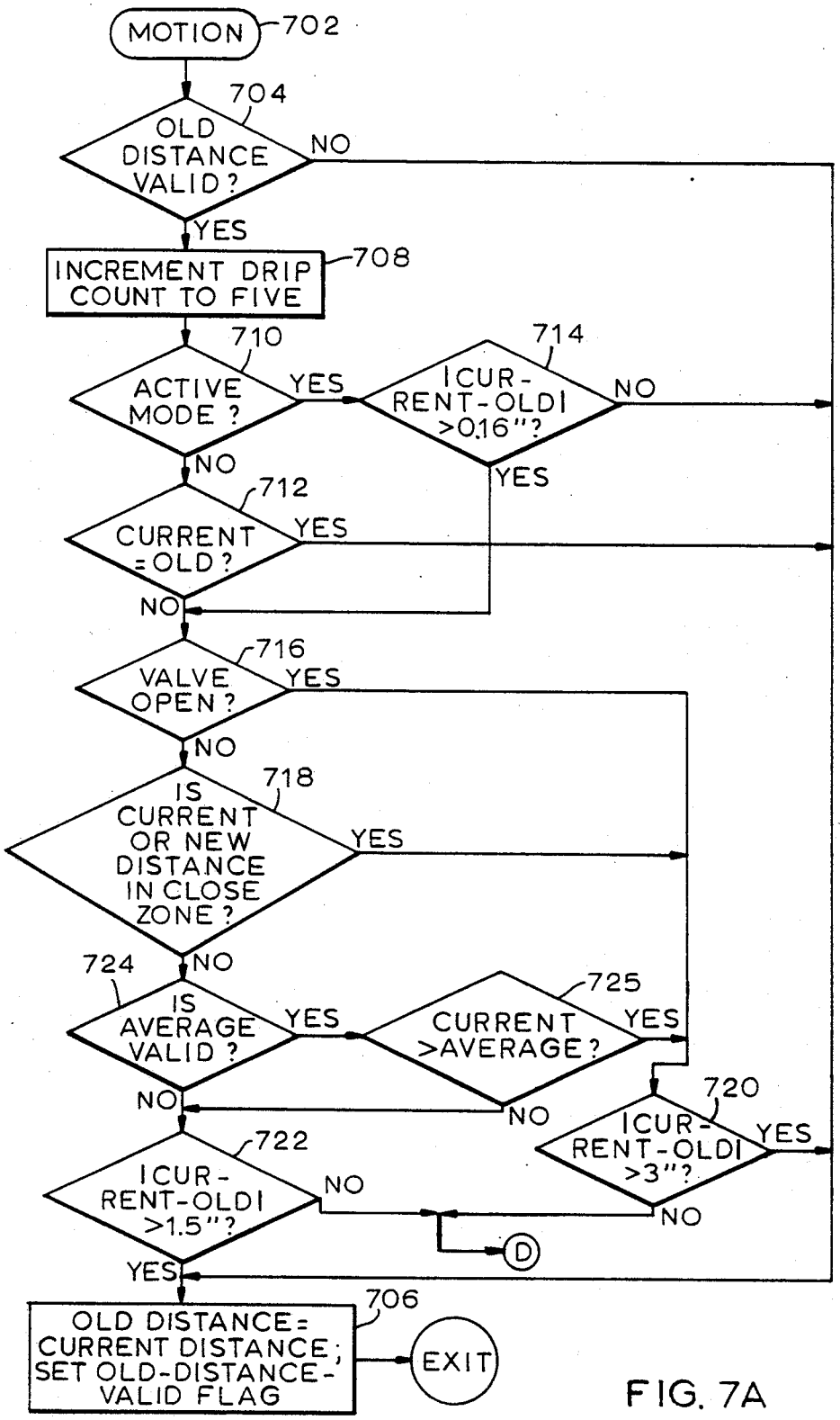
FIGS. 7A and 7B together are a flow chart of its subroutine for imposing various motion criteria.
Figure 7B:
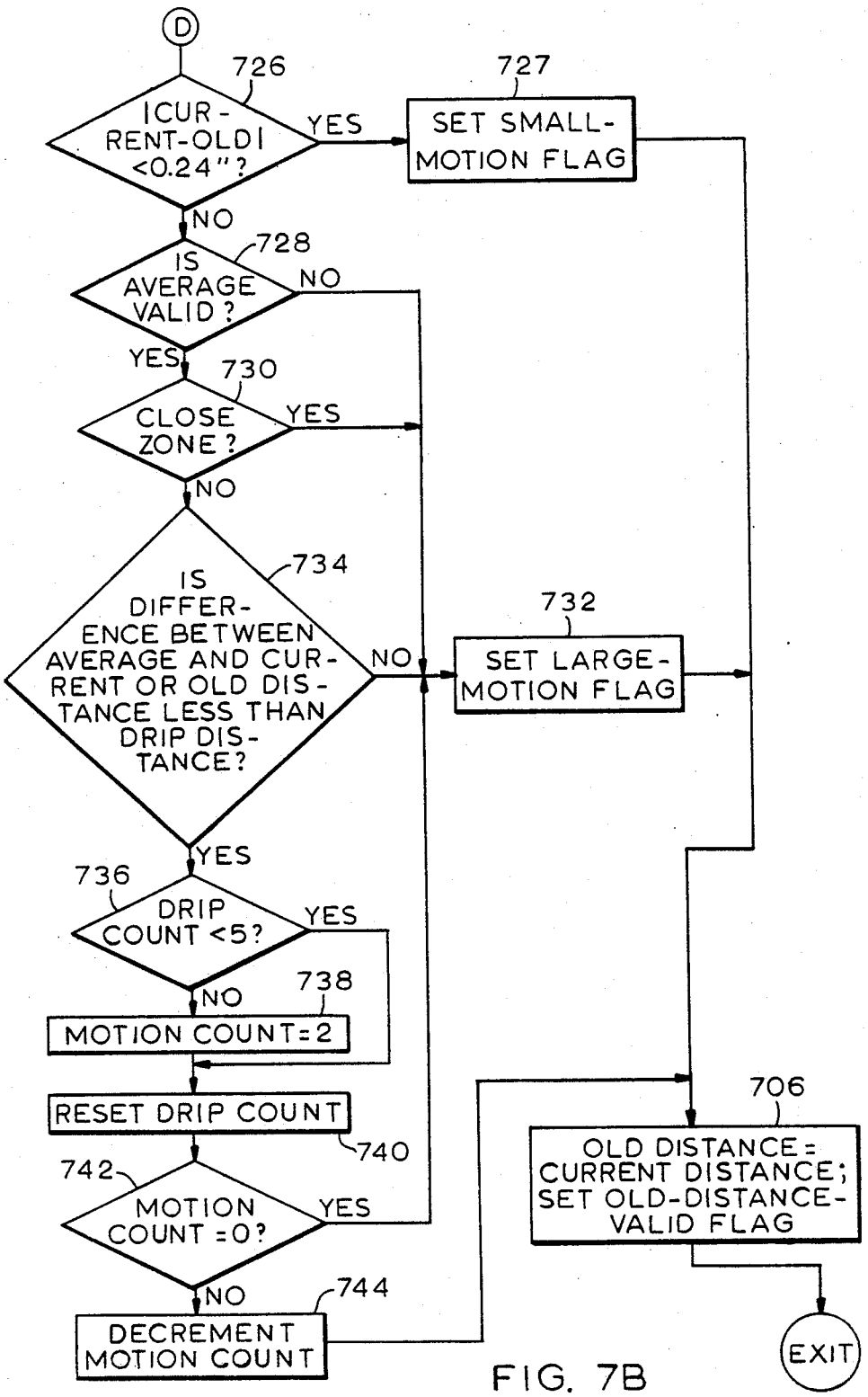

Although the sensing subroutine of FIGS. 6A and 6B determines the distance to the sensed object, the system imposes motion-based, rather than position-based, criteria to determine whether to open the valve. FIGS. 7A and 7B represent the motion subroutine for determining whether the requisite motion has occurred. Block 702 represents entry into this subroutine, in which the first step, represented by block 704, is to determine whether a previously measured "old distance" is considered valid. If it is not, the distance newly determined by the sense routine is loaded into the old-distance register, as block 706 indicates. Since a valid old distance has now been established, the old distance flag tested in the step represented by block 704 is set to its valid indicating state. The microprocessor then leaves the subroutine.

Once it is set, the old distance flag remains in its valid-indicating state even if a subsequent sensing operation detects no object and thus assigns no distance as a result of that operation. The last successfully measured distance therefore remains the value stored as an old distance—and the old distance flag remains in its valid-indicating state—unless, as was indicated by blocks 658 and 660 of FIG. 6B, the system fails one hundred times in a row to detect an object. If that happens, the "old distance" is finally considered invalid, and the old distance flag is reset to its invalidity-indicating value.

If the determination in the step represented by block 704 is that the old distance is valid, the microprocessor proceeds to the step represented by block 708, in which a drip counter, whose function will be described later, is incremented if its count has not yet reached five.

Blocks 710, 712, and 714 represent a determination of whether the difference between the old distance and the new distance exceeds a certain minimum, which is, say, 0.06 inch (0.15 centimeter) in the passive mode and 0.18 inch (0.46 centimeter) in the active mode. These distances correspond to one and three counter clock periods, respectively.

If the minimum motion has not been observed, the microprocessor simply leaves the motion subroutine after the substitution and flag setting represented by block 706. A review of FIGS. 5A and 5B and 6A and 6B reveals that the result of immediately leaving the motion subroutine after executing the step represented by block 706 is to cause the valve to remain closed, or, if it is open, to close if it has been open long enough since the last detection of the requisite motion.

More specifically, since the motion flags were reset in the step represented by block 602 of FIG. 6, and since they are not set in the motion subroutine of FIGS. 7A and 7B, the result of the test of one of the flags in the step represented by block 550 or 556 of FIG. 5B is to branch to the part of the main loop in which the system closes the valve if enough time has elapsed. On the other hand, if the result of the test represented by block 712 or 714 is that the system has observed the requisite motion, the microprocessor proceeds to the step represented by block 716.

The step represented by block 716 is the first of a number of steps, represented by blocks 718, 720, 722, 724, and 725, that reduce the likelihood that the faucet will be turned on in response to events that should not cause it to do so, such as splashing water or apparent motions resulting from momentary reflections of ultrasound from the surface of standing water. As blocks 716, 718, and 720 indicate, if the valve is open, or if the valve is closed but neither the previously measured nor the currently measured distance represents a position in the close zone, the routine imposes a requirement that the difference between the last measurement and a current measurement be less than 3 inches (i.e., 7.6 centimeters or 500 counter units). If the motion is more than 3 inches, the motion is not considered a valid motion, and the microprocessor leaves the motion routine without setting either of the motion flags.

This requirement is imposed because the user's movement of a dish or his hand, for instance, is unlikely to result in a position change of 3 inches between sensing operations, but such a position change can very well result from splashing water. It can also be the result of pure reflections from the surface of standing water. The surface of standing water can act like a sonic mirror to the ultrasound used for sensing; that is, unlike most surfaces, which scatter the sound in all directions, standing water can reflect nearly all of the ultrasound in substantially a single direction dictated by the angle of incidence of the ultrasound. Since the surface of the water ordinarily is not completely still, however, the angle of incidence changes, and the ultrasound is sometimes reflected back to the transducer and sometimes away from it. Consequently, the sensor sometimes detects the water surface and sometimes detects objects farther away, thereby making measurements that suggest motion when there is none. If the difference between the distance to the water surface and the distance to the other object is greater than 3 inches, however, the apparatus of the present invention will ignore the apparent motion, and the valve will not be triggered erroneously.

Of course, the choice of a 3-inch threshold is somewhat arbitrary, but we have found that, for most situations, the threshold should not be much less than 3 inches, because lower thresholds tend to result in the system's ignoring valid motions. However, there is one particular common situation in which an apparent motion significantly less than 3 inches is likely to be invalid motion. That situation arises when a cup is placed on, for instance, a stack of plates. A cup can contain standing water that is intermittently detected by the sensor circuitry. Between cycles in which the sensor circuitry detects the standing water, it detects the top of the stack of dishes on which the cup has been placed. A typical cup is considerably less than 3 inches deep, so the apparent motion is less than 3 inches, but it is still erroneous motion, and it is desirable for the system to ignore "motion" of this type. To cause the system to ignore such apparent motion without unduly reducing its sensitivity to valid motion, the system of the present invention includes an alternate threshold, represented by block 722, which is imposed only when the motion meets a criterion intended to favor the cup on-a-stack-of-dishes situation. In order to describe this criterion, it is necessary to digress to FIG. 8, which represents a routine for computing and validating an average distance value.

As was indicated in connection with FIG. 5, the average routine is called during each cycle in which the main loop calls the sense routine. The purpose of the average distance value is, roughly, to indicate the position of a substantially stationary object. For instance, if the system detects the surface of standing water in a saucer, and the position of that surface does not change, the valve will be turned off. Since the water surface is a good reflector, however, it is subject to being missed intermittently, as was explained above, and objects behind it will be detected so as to cause apparent, but erroneous, motion. Also, since the cup is less than 3 inches deep, the apparent motion will be less than the 3-inch threshold ordinarily used to exclude invalid motion.

To reduce the likelihood of erroneous motion detection in this situation, the system imposes a lower, 1.5-inch threshold when the detected distance usually is near an "average" value but occasionally assumes a distance greater than the average distance. The lower threshold is not imposed when the occasional value is less than the average distance; i.e., this criterion is based on direction. This direction-based criterion reduces the likelihood of responding to reflection-caused erroneous motions but does not unduly reduce the sensitivity of the system to valid motions.

The average value is computed from eight distance measurements made in the active mode just before the valve is closed. The average counter counts the number of distance measurements that have gone into the average computation, and the average-valid flag is set when the requisite eight measurements have been completed.

As was stated in connection with block 571 of FIG. 5B, the average counter and average-valid flag are reset during each main loop in which enough motion has been detected to keep the valve open. As will be explained in connection with FIG. 8, this keeps the average-value computation from being completed so long as the requisite motion is present. If the requisite motion is not present, however, the main loop does not reach block 571, so the counter is allowed to increment in the FIG. 8 routine, which the main loop calls on each pass at block 570. Because of the delay imposed by the valve-open timer in the steps of blocks 576 and 578, enough main-loop cycles will occur before the valve is closed in the step of block 580 to allow the average counter to be incremented to eight and thereby complete the average-value computation.

Figure 8:
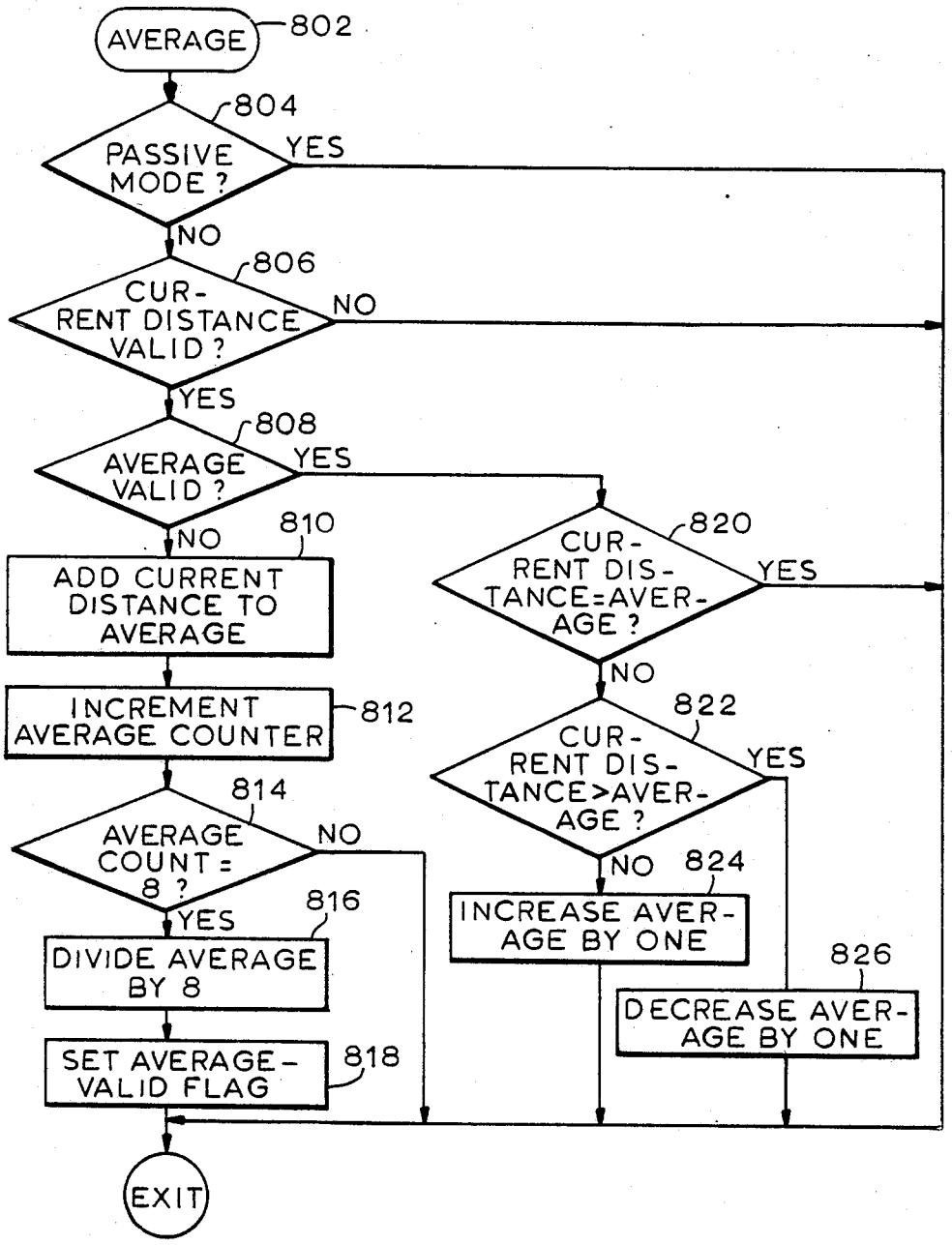
FIG. 8 is a flow chart of its subroutine for computing the average distance.

The routine of FIG. 8 computes and validates this average motion. Block 802 represents entry into the subroutine. Block 804 represents the first step, which is to determine whether the system is in the passive mode. If it is, the system detects only objects in the close zone, where an object such as a stationary saucer is not ordinarily found. Accordingly, the microprocessor immediately leaves the average subroutine if the system is in the passive mode.

If the system is not in the passive mode, the microprocessor proceeds to a step represented by block 806, in which the microprocessor branches on the state of the current-distance flag, which, as was explained previously, indicates whether a valid distance measurement resulted from the last sensing operation. If a valid measurement did not result, the microprocessor leaves the average-distance routine. Otherwise, it proceeds to the step represented by block 808, in which it tests an average-valid flag.

On initialization, the average-valid flag is reset to indicate invalidity, and it can also be reset in the main loop and in the sensing subroutine, as was stated above. On the other hand, the average-valid flag is set to indicate validity at the end of the average-distance subroutine of FIG. 8 if that subroutine successfully computes an average value.

If the average value is not yet valid at the block-808 step, the subroutine proceeds to the step represented by block 810, in which the new distance is added to the value currently in the average-distance register. The microprocessor then increments an average counter, as block 812 indicates.

In order to be a valid average value, the average must be computed from eight distance values, and block 814 represents a test to determine whether the average counter indicates that the number of distances added together so far has reached eight. If it has, their sum is divided by eight, as block 816 indicates, to generate the average of their values, and the average-valid flag is set, as block 818 indicates. The microprocessor then returns to the main loop. The microprocessor also returns to the main loop if the average counter has not yet reached a count of eight, but it does so without computing the average or setting the average-valid flag to the validity-indicating value.

If, in the step represented by block 808, the microprocessor determines that a valid average value already exists, the microprocessor incrementally adjusts the already-valid average value in accordance with the newly measured distance. As blocks 820, 822, 824, and 826 indicate, the average is increased by one if the new distance is greater than the average, and it is decreased by one if the new distance is less. If the new distance equals the average, the average remains the same. This has the effect of gradually adjusting the average to reflect slow position changes. The microprocessor then returns to the main loop.

Clearly, the "average" value is not strictly an average, but it does not need to be; it needs only to be an indication of where a more-or-less stationary object is located. Thus, alternate measures of computing such a value could be employed, such as multiplying the existing average by n, adding it to the new distance, and dividing the result by $n+1$.

The motion subroutine of FIG. 7A employs this average value in a manner represented by blocks 722, 724, and 725. Whenever neither the current distance nor the old distance falls within the close zone, a 1.5-inch (3.8-centimeter) threshold is applied if the average distance is not yet valid. But if the average-valid flag indicates that an average value has been successfully computed, the system reverts to the 3-inch threshold if the current distance is not greater than the average distance. In short, the system ordinarily imposes a 1.5-inch cut-off so as to avoid being "tricked" by the standing-water-in-a-cup situation, but if there is apparent motion to a position closer to the faucet than the average distance, the standing-water-in-a-cup situation is ruled out, and the greater sensitivity of a 3-inch cut-off is obtained. By computing an average and imposing a direction rule, therefore, a degree of sensitivity to valid motion can be retained while the possibility of responding to erroneous motion determinations caused by reflection is reduced.

If the detected motion is not eliminated from consideration by the excess-motion criterion, the microprocessor proceeds to a step represented by block 726 of FIG. 7B, in which the microprocessor compares the new distance with the old distance to determine whether the difference is greater than 0.24 inch (0.61 centimeter). If it is not, then the small-motion flag is set, as block 727 indicates; the block-726 step could not have been reached unless the motion had passed the block-712 test for at least one unit, i.e., 0.06 inch or 0.15 centimeter, of motion. After setting the small-motion flag, the subroutine performs the step represented by block 706 and returns to the sense routine.

If the block-726 determination is that the difference between the old and new distances is four units or more, the microprocessor begins a section of the routine in which it determines whether to set the large-motion flag. Ordinarily, that flag is simply set whenever the difference between the old distance and the new distance is four units or more. However, a possible cause of erroneous motion determinations is dripping water, and we have found that objects detected near a previously stationary object are very likely to be water drips rather than valid motions. Accordingly, the microprocessor simply requires four-unit motion when the detected object is more than a predetermined "drip distance" from the average-distance value, but it applies different criteria if the detected object is within the drip distance of the average distance.

The remaining blocks in FIG. 7B depict the alternate criteria. As blocks 728, 730, and 732 indicate, the large-motion flag is set if no average distance has yet been validly determined so as to form a basis for deciding whether the object is within the drip distance of the average distance. Additionally, if the object is in the close zone, the simple four-unit criterion is applied.

However, if an average distance has been validly computed and the object is not in the close zone, then the microprocessor determines whether the current or old distance differs from the average distance by less than the drip distance. If neither does, the general criterion is again applied, as blocks 732 and 734 indicate. If one or the other of the measured distances is within the drip-distance neighborhood of the valid average distance, on the other hand, the microprocessor applies different criteria.

According to these criteria, a simple distance difference of more than four units is not enough to cause the large-motion flag to be set. If the detected object is within that neighborhood, the four-unit motion must have occurred three times in the drip-distance neighborhood. The three times need not occur on successive sensing cycles, but they must all occur before five sensing cycles have passed since the last three unit motion.

These criteria are implemented by steps represented by blocks 736, 738, 740, 742, and 744. Block 736 represents the determination of whether the drip counter, which was incremented in the step represented by block 708, has reached a count of five. As will become apparent directly, a drip count of five is an indication that five sensing cycles have passed without four unit motion within the drip-distance neighborhood. If the drip count is five, then the system starts over again to count the three four-unit motions required to cause the valve to open; specifically, a motion counter is set to two, as block 738 indicates. On the other hand, if the drip counter has not reached a count of five, the motion counter is not reset to two, and it retains the value to which it was decremented during previous cycles.

In either event, the drip counter is reset, as block 740 indicates, so as to re start the count of sensing cycles that do not detect four unit motion within the drip-count neighborhood of the average distance. If, as a result of the previous pass through the motion subroutine, the motion counter was decremented to zero, the special motion criteria for the drip-distance neighborhood have been met. The microprocessor therefore branches, as block 742 indicates, to the block-732 step in which the large-motion flag is set. On the other hand, if the motion counter has not yet been decremented to zero—i.e., if two previous instances of sufficient motion within the drip-distance neighborhood have not occurred with less than five intervening sensing cycles—the motion flag is not set. Instead, the microprocessor decrements the motion counter and leaves the motion subroutine.

In short, by computing an average-distance value and applying different motion criteria in accordance with the relationship between the currently determined distance and the average-distance value, the incidences of erroneous motion detection can be reduced while minimizing the reduction in sensitivity to valid motion.

Figure 9:
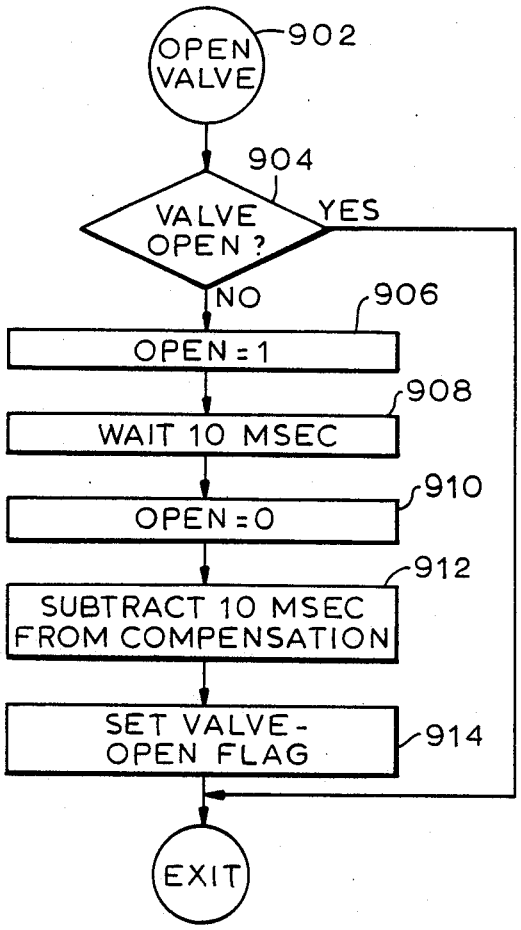
FIG. 9 is a flow chart of its valve opening subroutine.

We now turn to the valve-opening subroutine of FIG. 9, which the main loop calls in the step represented by block 572. Block 902 represents entry into the valve-opening subroutine. Block 904 represents testing the flag that indicates the state of the valve. If the valve is already open, there is no need to expend the energy required to open it, and the microprocessor leaves the valve-opening subroutine. If the valve is not open, the microprocessor proceeds to the step represented by block 906, in which it causes its OPEN output to assume a high value, thereby causing the valve circuitry of FIG. 4 to open the valve. The OPEN signal has to be high for a long enough time to enable the circuit to respond, so the microprocessor waits for a period of 10 milliseconds, as block 908 indicates. It then returns the OPEN signal to its low value, as block 910 indicates.

For data-logging purposes, it was desirable in a prototype version of the invention for the main loop to take as long when the valve was being opened as it did when the valve was not being operated. For this reason, the microprocessor subtracts 10 milliseconds from the value represented by the contents of the compensation-time register, as block 912 indicates. Consequently, when the microprocessor turns off for the compensation time in the step represented by block 528 of FIG. 5, the total of that compensation time plus the 10 milliseconds waited during the step represented by block 908 equals the normal compensation time experienced when the valve is not being activated.

Having opened the valve, the microprocessor sets its valve-open flag to the state representing an open valve, as block 914 indicates, and it leaves the valve opening subroutine.

Figure 10:
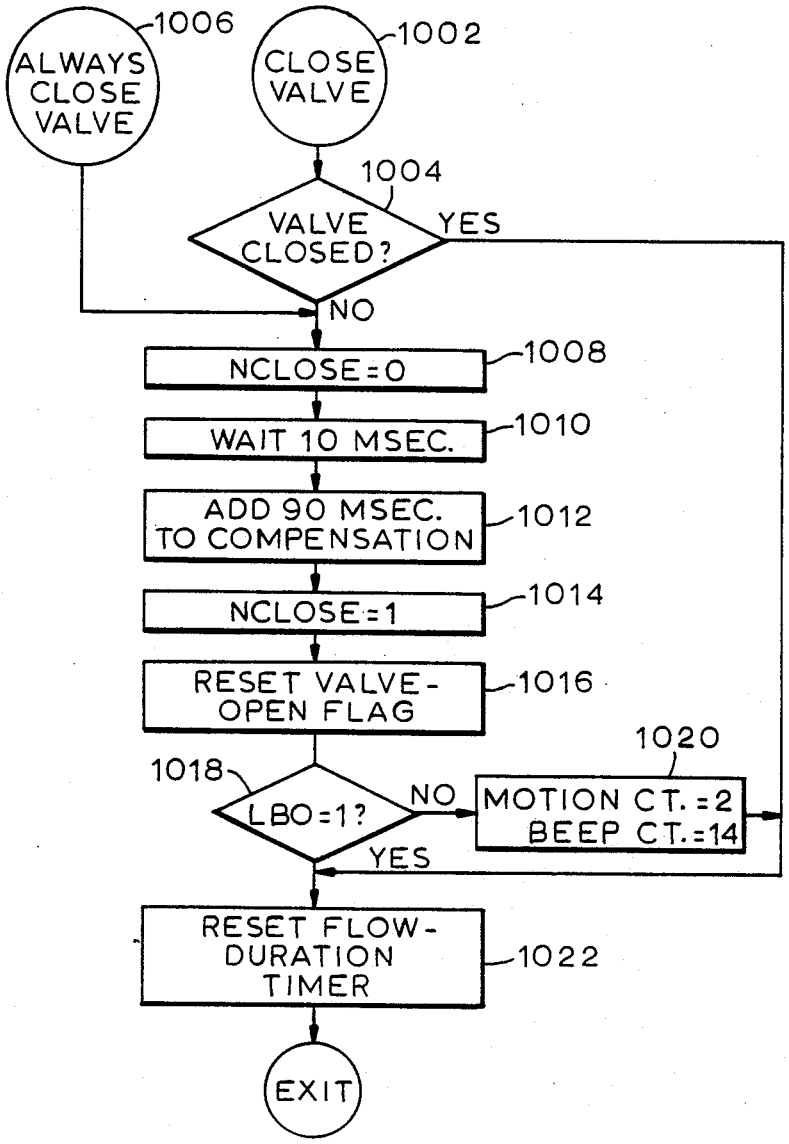
FIG. 10 is a flow chart of its valve-closing subroutine.

FIG. 10 represents a subroutine, entered in one of two ways, for closing the valve. When the valve-closing subroutine is called in the normal way, in the step represented by block 580 of FIG. 5, the routine is entered at the point represented by block 1002 of FIG. 10. From that point, it first determines whether the valve flag is in the state representing a closed valve, as block 1004 indicates. If the valve is closed, the routine bypasses the valve operating steps and thereby avoids expending energy unnecessarily to close an already-closed valve.

The other way to call the valve-closing subroutine is the way used when the flow-duration timer reaches a value representing a time greater than one minute. In such a situation, an emergency condition is considered to exist, and the valve flag may be incorrect. The microprocessor therefore enters the subroutine of FIG. 10 at the point represented by block 1006, from which it proceeds to close the valve regardless of whether the valve flag indicates a closed condition.

To close the valve, the microprocessor sets the NCLOSE signal to its low value, thereby operating the valve closing part of the circuit of FIG. 4. Block 1008 represents this step. Again, the microprocessor waits 10 milliseconds, as block 1010 indicates, so that the valve-opening pulse will be long enough. The microprocessor also adds 90 milliseconds to the compensation time, as block 1012 indicates, so that a main loop in which a valve-closing operation occurs ends up taking about 200 milliseconds This 200-millisecond delay allows the water to settle so that splashes do not cause the faucet to turn back on.

The microprocessor next resets the NCLOSE signal to its high value, as block 1014 indicates, to end the valve-closing pulse. As block 1016 indicates, the valve-open flag is then set to its closed-indicating condition.

The microprocessor then checks the value of the LBO signal generated by the voltage regulator 208. The system produces an audible signal when the battery is low. Since the actual operation of the valve is what takes the most current, the system tests the LBO (low-battery output) signal only when the valve is operated. Moreover, since it is hard to hear the low-battery signal while the water is running, the test is made only during valve-closing operation.

Block 1018 represents branching on the value of the LBO signal. If that signal indicates that the battery voltage is low, the routine proceeds to the step represented by block 1020, in which it sets to two the motion count tested in block 742 of FIG. 7 and sets to fourteen the beep count tested in block 526 of the main loop. The result of this latter step is that the main loop will call a subroutine, described below in connection with FIG. 13, for producing the audible signal.

Regardless of the value of the LBO signal, the microprocessor then proceeds to the step represented by block 1022, in which it resets the flow-duration timer because the valve is no longer open. It then returns to the main loop.

Figure 11:
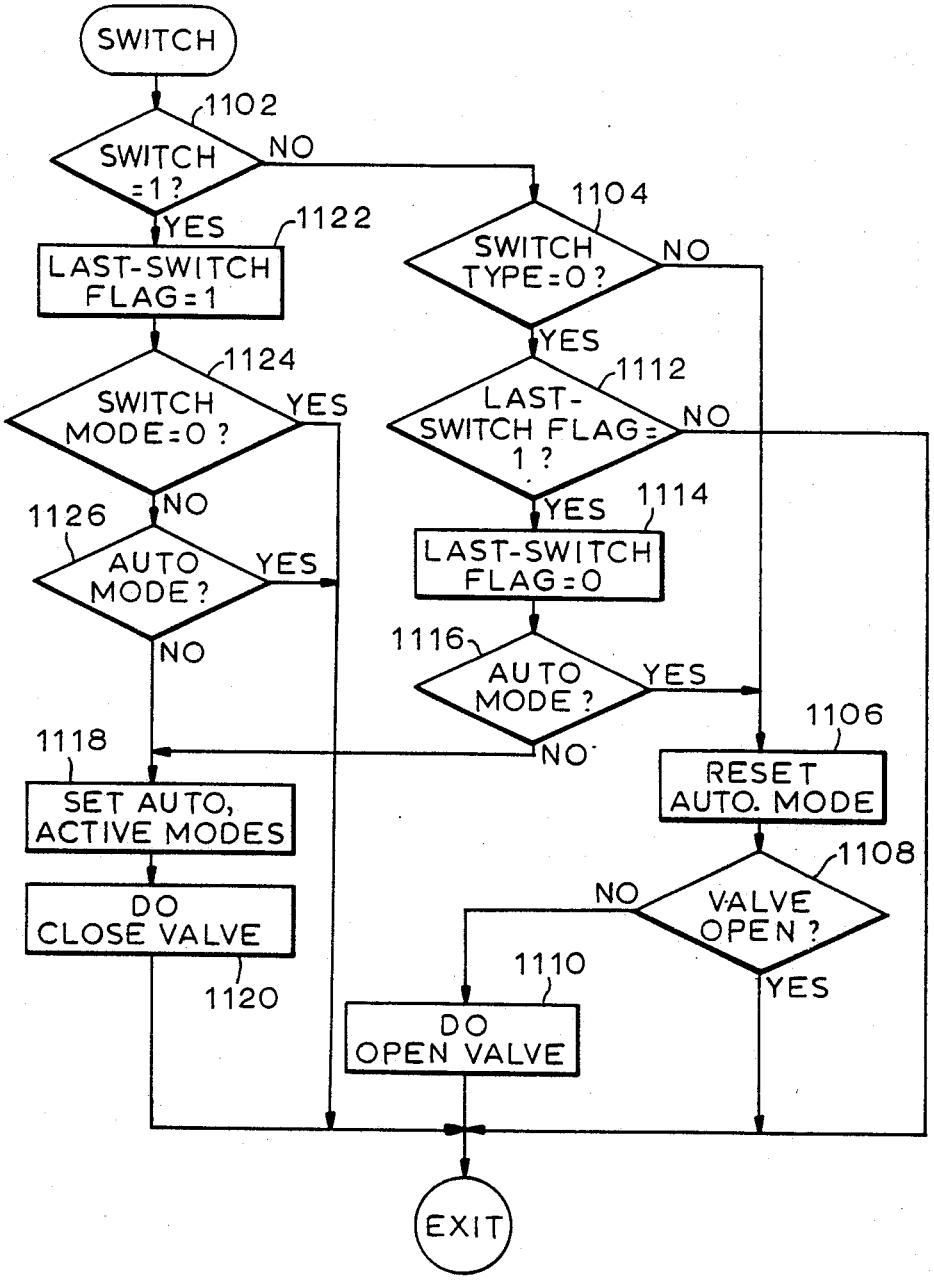
FIG. 11 is a flow chart of its switch-interrogation subroutine.

As was indicated in connection with FIG. 5, the main loop starts by calling a switch-interrogating routine. FIG. 11 depicts this routine, in which block 1102 represents sensing the electrical output of the switch. The switch output is binary, its two possible states arbitrarily being designated 0 and 1. In the illustrated embodiment, the circuitry is arranged to respond to either a momentary switch or a toggle switch, and a jumper P1 (FIG. 2) indicates the switch type. In the case of a momentary switch, the zero state is the output of the switch when it is actually being depressed, and the microprocessor branches to the right at block 1102 in FIG. 11 when it detects that output.

Block 1104 represents branching on the presence or absence of the switch-type jumper JP2. If the switch is of the toggle variety, the zero output detected at the block-1102 step simply means that the system is to be operated manually. The microprocessor therefore resets the automatic-mode flag, as block 1106 indicates, to indicate that the mode is manual and opens the valve if it is not already open, as blocks 1108 and 1110 indicate. The microprocessor then returns to the main loop.

On the other hand, if the switch is a momentary switch, the microprocessor branches at block 1112 on the condition of a last-switch flag. If the SWITCH output sensed during the previous cycle through the main loop was zero, as it was determined to be at block 1102 for the current cycle, the microprocessor concludes that the user simply has not yet released the switch, so it merely leaves the switch-interrogation routine.

But if the last output was one rather than zero, the user has just operated the switch. The routine sets the last-switch flag to zero, as block 1114 indicates, to represent the output sensed during the current cycle. It also determines whether the system previously was in manual or automatic operation, as block 1116 indicates. If the system previously was operating automatically, the routine branches to the step represented by block 1106 to switch the system to manual operation. If the system previously was operating manually, on other hand, the routine branches to the step represented by block 1118, in which a flag is set to indicate that the system is now operating automatically. The active-mode flag is also set so that the system begins automatic operation in the active mode. As block 1120 indicates, the microprocessor also closes the valve (which is always open in the manual mode) before returning to the main loop.

If, in the step represented by block 1102, the microprocessor determined that the output of the switch was one, the microprocessor sets the last-switch flag to a value of one. Since one is the output of the momentary switch when it is not being depressed, the system does not need to respond if the switch is a momentary switch, and it therefore does not need to consult the value sensed during the last cycle. It thus can immediately set the last-switch flag to the sensed value of one, as block 1122 indicates.

The microprocessor then interrogates the switch-type jumper, as block 1124 indicates. If the switch is a momentary switch, the system does not need to respond, as was just explained, so the microprocessor leaves the switch-interrogating subroutine. If the switch is a toggle switch, a SWITCH output of one indicates that the system should operate automatically, and if it already is, the microprocessor leaves the switch-interrogation routine, as block 1126 indicates. Otherwise, it proceeds to set flags to indicate that the system is operating automatically in its active mode, as block 1118 indicates. The microprocessor thereupon closes the valve, as block 1120 indicates, and returns to the main loop.

Figure 12:
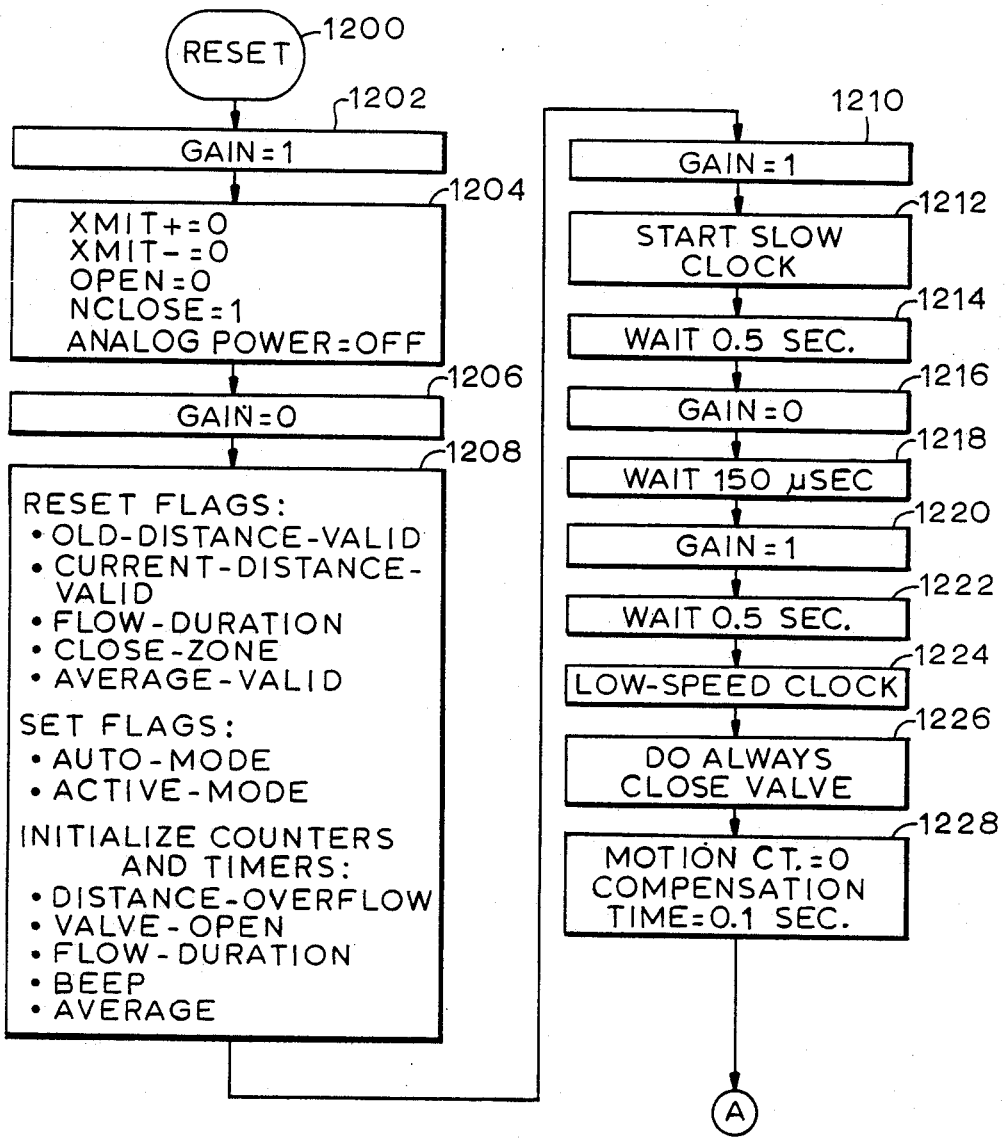
FIG. 12 is a flow chart of its reset subroutine.

FIG. 12 depicts the routine performed by the system when it is initially turned on or is otherwise reset. Block 1200 represents entry into the routine When the microprocessor 202 is reset, it starts the fast clock running, and it places in a high-impedance state the output port connected to line 218, the line by which the microprocessor controls GAIN. With that port in the high-impedance state, operation of the fast clock causes intermittent conduction of transistor Q10 so that it charges capacitor C4 to a level that releases the reset condition of the microprocessor. If the microprocessor terminal to which line 218 is connected were to remain in the high-impedance state, the operation of the fast clock would continue to keep capacitor C4 charged and thus prevent the microprocessor from being reset. As was indicated previously, however, it is important for the microprocessor to reset when operation stops in an unintended fashion. For this reason, the microprocessor performs step 1202, in which it drives the GAIN-setting line 218 high. That is, the microprocessor port that is connected to line 218 is no longer in the high-impedance state, and the result is that the operation of the fast clock can no longer cause transistor Q10 to conduct Capacitor C4 accordingly begins to discharge, and, if an error occurred that caused the program to "hang up," capacitor C4 would discharge to the point at which it causes the microprocessor 202 to reset.

In normal operation, however, the microprocessor continues to a step in which it places several output signals in the states indicated in Block 1204. This operation takes less time than it would take for capacitor C4 to discharge to the resetting level, and the microprocessor then proceeds to step 1206, in which it drives the GAIN-controlling line 218 low, thereby causing transistor Q10 to conduct and begin to charge capacitor C4.

The microprocessor 202 thereupon proceeds to step 1208, in which it sets and resets the several flags and initiates the several counters and timers listed in that block. This gives capacitor C4 time to accumulate significant charge, and the microprocessor then proceeds to step 1210, in which it switches the GAIN value back to one and thereby turns off transistor Q10. In step 1212, the microprocessor 202 starts its slow clock but does not begin clocking from the slow clock output; the slow clock takes some time to stabilize. Instead, it waits half a second, as block 1214 indicates, and then sets GAIN to zero so as to turn on transistor Q10, charge capacitor C4, and prevent the microprocessor 202 from resetting. After a wait of 150 microseconds, represented by block 1218, the microprocessor 202 switches the GAIN signal back to a value of one, as block 1220 indicates, and waits another half second in step 1222. By this time, the slow clock has settled, so the microprocessor 202 switches to the slow clock in a step represented by block 1224. It then executes the valve-closing subroutine of FIG. 10, entering it at step 1006. Block 1226 represents this step. Finally, in a step represented by block 1228, the microprocessor sets the motion counter to zero and the compensation time to 0.1 second. It then enters the main loop depicted in FIG. 5.

Figure 13A:
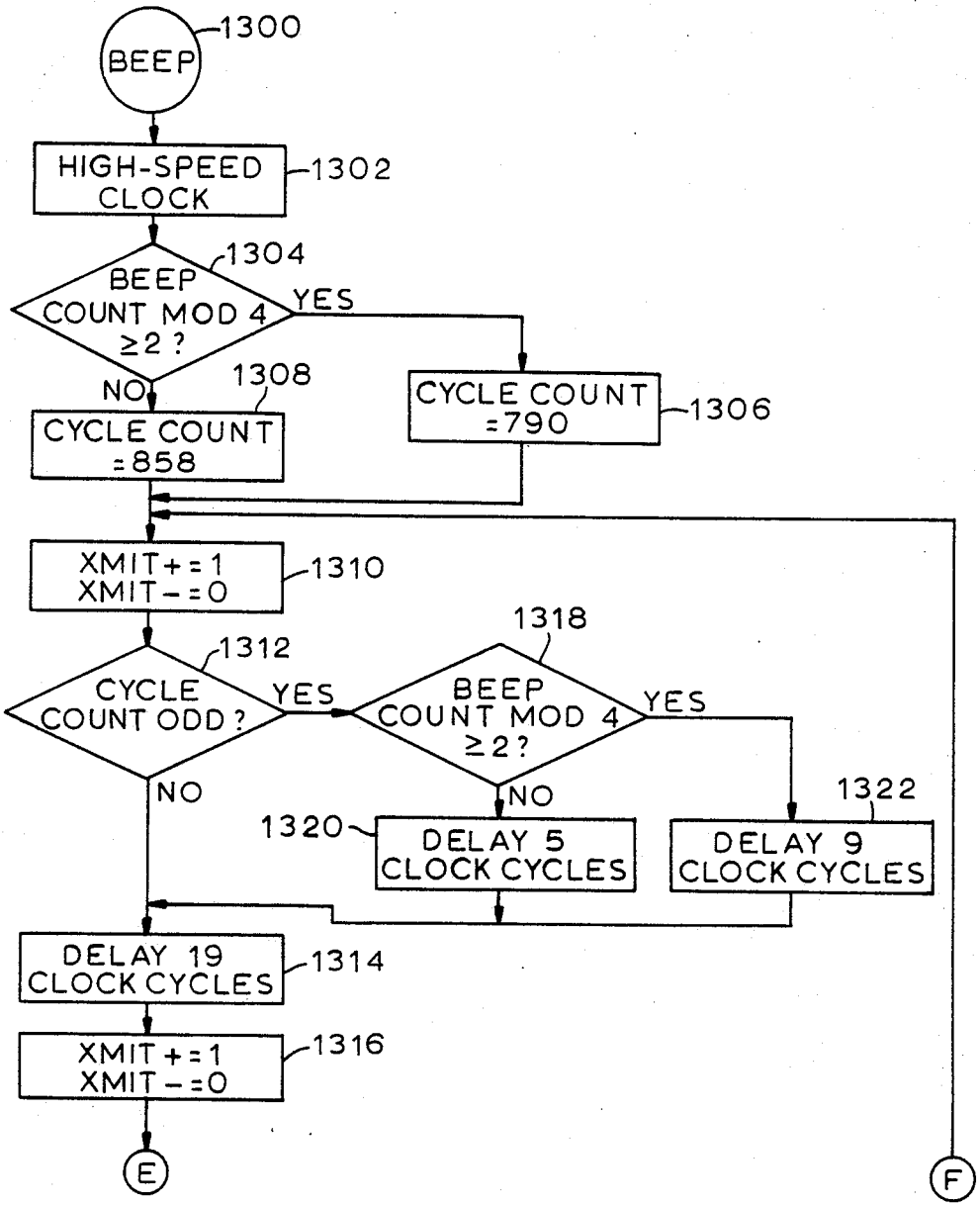
FIGS. 13A and 13B together are a flow chart of its subroutine for generating an audible indication that the battery voltage is low.
Figure 13B:
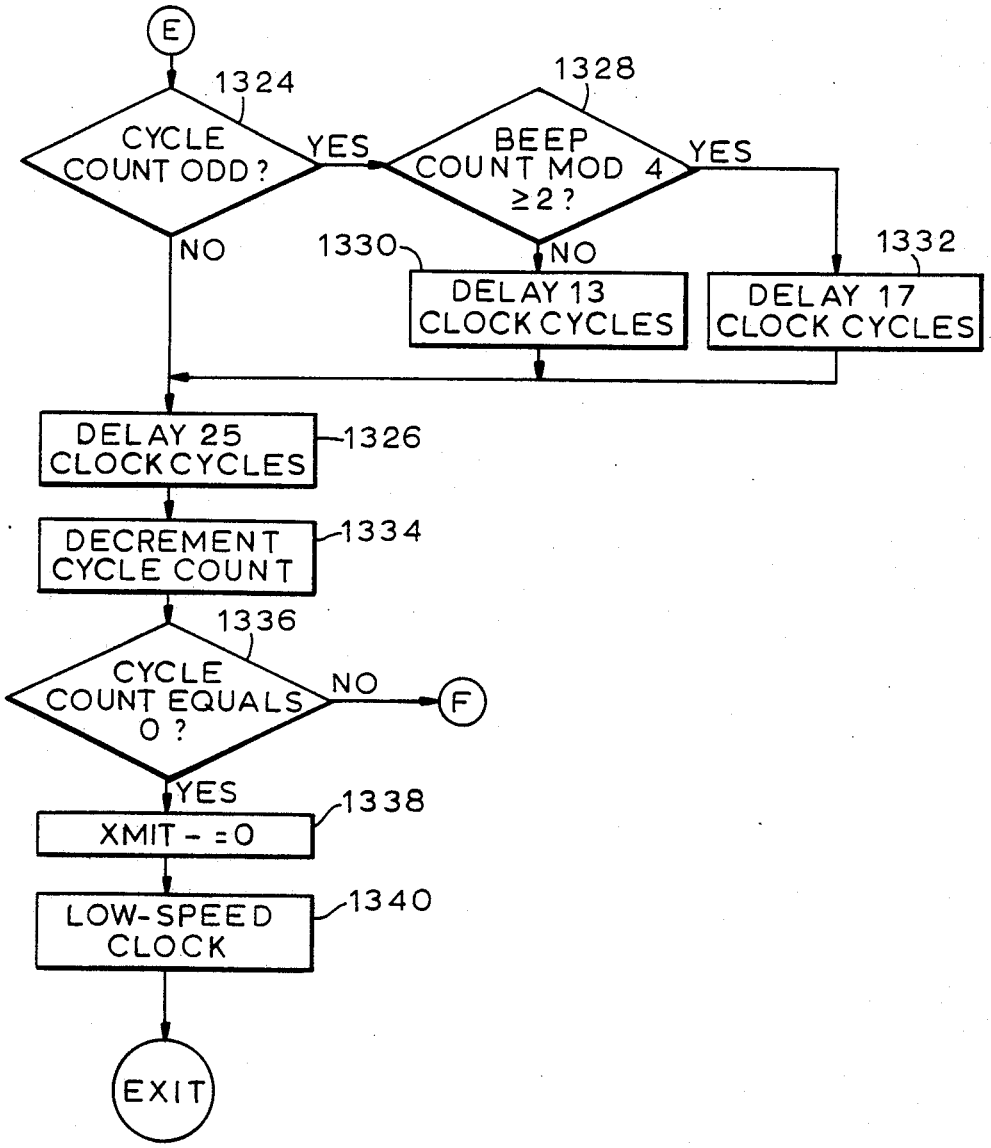

FIGS. 13A and 13B depict a final subroutine incorporated in the programming for the valve-control system of the present invention. This is a beep-generation routine, which the main loop of FIG. 5 calls at step 534.

To describe the beep subroutine effectively, it is necessary first to digress to the portion of the main loop of FIGS. 5A and 5B represented by blocks 526-38. As was stated previously, the beep counter is set to a value of fourteen whenever the valve closes if the LBO signal has a value of one, indicating that the battery is low. In such a situation, the result of the test of block 526 is negative, so the microprocessor decrements the beep count in a step represented by block 530. It then proceeds to determine whether the decrementing has reduced the beep count to a value of eight. If it has not—i.e., if the beep count is still greater than eight—the microprocessor proceeds to the step represented by block 528, in which it simply waits for the compensation time and then proceeds with the main loop without having called the beep routine. Thus, since the beep count was initially set to fourteen, the microprocessor proceeds through five main-loop cycles before it enters the beep routine. The reason for this is to delay the beginning of the beep operation for a predetermined time interval after the valve is initially shut so that the noise from the flowing water can die out. When this predetermined interval is over—that is, when the beep count has been decremented to a count of eight—the result of the step-532 determination is negative and the microprocessor proceeds to step 534, in which it calls the beep routine. As will be explained below, the beep routine produces an audible signal to alert the user to the fact that the battery is low.

In step 536, the microprocessor sets the compensation time to 0.1 second and then proceeds to step 538, in which the microprocessor determines whether the beep count is less than seven. If it is not, the microprocessor simply returns to the beginning of the main loop without performing a sensing operation. The reason for this is to prevent the valve from opening—and the resultant noise from occurring—before the system has performed the beep operation at least twice. In the absence of such a provision, the valve could open before the beeps occur, and the water noise would mask the beep and thereby prevent the user from being warned of the low-battery condition.

Once the beep count falls below seven, however, the system again begins performing the sense operation on each pass through the main loop. The valve could thereby open during one of these passes, but the microprocessor still performs the beep operation on every pass through the main loop until the beep count has been decremented to zero. Consequently, the microprocessor performs the beep operation nine times in a row, regardless of whether the valve opens.

The microprocessor enters the beep routine at step 1300. At step 1302, it switches to the fast clock so that the microprocessor can operate quickly enough to make the necessary calculations for beep generation in real time. It then proceeds to block 1304, in which it branches on the value of the beep count. If the modulo-4 value of the beep count is greater than or equal to two, the microprocessor sets a cycle counter to 790, as block 1306 indicates. Otherwise, it sets the cycle counter to 858, as block 1308 indicates.

The purpose of this cycle counter can be appreciated by referring to FIGS. 14, 15A, and 15B. FIG. 14 depicts the pattern of sounds that it is the intent of the beep routine to produce. Point 1402 in FIG. 14 represents the time at which the valve closes. When the valve closes, the valve-closure routine sets the beep counter to 14, as block 1020 of FIG. 10 indicates. But the valve-closure routine returns control to the main loop depicted in FIG. 5, in which, at step 530, the beep count is immediately decremented to a value of 13. Accordingly, FIG. 14 depicts the beep count as being 13 when the valve closes.

As was explained in connection with FIG. 5, the main loop does not transfer control to the beep routine when the value of the beep count is greater than or equal to 8. As a consequence, the system produces no audible sound during the first 100-millisecond pass through the main loop. It similarly produces no audible sound, as FIG. 14 indicates, for the next five passes, i.e., until the beep count reaches a value of seven, at which point the main loop calls the beep routine of FIG. 13.

As described below, the loop routine then generates a 90-millisecond burst of a signal depicted in 15A. This signal comprises 409 cycles of first and second types. The first type of cycle has a 41-microsecond high interval followed by a 53-microsecond low interval. The next cycle has a 61-microsecond high interval and a 73-microsecond low interval. These two types of cycles alternate for 90 milliseconds. After 90 milliseconds, the beep routine returns control to the main loop, which imposes a 10-millisecond delay before calling the beep routine again. The main loop repeatedly calls the beep routine in this fashion, the beep count being decremented each time, until the beep count reaches the value of zero. The main loop then refrains from calling the beep routine until the valve-closing routine again sets the beep count to a value of fourteen.

As was just explained, the system produces eight bursts of audible sound in a row. FIG. 15A represents the signal that the beep routine generates when the beep count has values of seven, six, three and two; that is, this is the signal that the beep routine produces when the modulo-4 value of the beep count is greater than or equal to two. When the modulo-4 value of the beep count is less than two, on the other hand, the beep routine generates the signal depicted in FIG. 15B, which is similar to the signal depicted in FIG. 15A with the exception that the second cycle of the FIG. 15B signal has a 53-microsecond high interval and a 64-microsecond low interval. Because of this difference, it takes more cycles of the signal depicted in FIG. 15B to equal 90 milliseconds than it does of the signal depicted in FIG. 15A. The cycle counter, whose purpose is to indicate how many cycles are left in the signal burst, is therefore set to 790, as block 1306 indicates, if the modulo-4 value of the beep count is greater or equal to two. If the modulo-4 value of the beep count is less than two, the cycle counter is set to 858, as block 1308 indicates.

In step 1310, the microcontroller 202 then sets its XMIT+ output to one and XMIT− output to zero. These are the signals that drive transducer 210.

The next step, represented by block 1312, begins implementation of alternating between short cycles and long cycles. On the first pass through the beep routine, the cycle count is even, so the result of the test represented by block 1312 is negative, and the routine proceeds to the step represented by block 1314, in which the microcontroller 202 imposes a delay and then reverses the XMIT+ and XMIT− signals, as block 1316 indicates. The delay imposed in step 1314 is the amount of time that, when added to the time required by the microcontroller 202 to execute the relevant steps in the program, causes the time between step 1310 and 1316 to equal the 41 microseconds intended for the first half cycle of the transducer signal.

On alternate cycles, however, the cycle count is odd, and the result of step 1312 is affirmative. Accordingly, the microcontroller 202 must impose an additional delay. When the modulo-4 value of the beep count is greater than or equal to two, this additional delay is 20 microseconds (41+20=61), while the delay when the modulo-4 value of the beep count is less than two is equal to 12 microseconds (41+12=53). In step 1318, therefore, the beep routine branches on the value of the beep count to determine whether the additional delay should be 12 microseconds or 20 microseconds. In the former case, the routine proceeds to step 1320, in which the microcontroller 202 imposes another delay. This delay, when added to the time required to execute the step represented by block 1318, equals 12 microseconds. In the latter case, the routine proceeds to step 1322, in which the delay imposed results in 20 microseconds. The routine then proceeds with steps 1314 and 1316 as before, and the second half cycle begins.

In the second half cycle, the microcontroller imposes a delay the same as that imposed during the first half cycle: steps 1324, 1326, 1328, 1330, and 1332 (FIG. 13B) in the second half cycle are substantially equivalent to steps 1312, 1314, 1318, 1320, and 1322 of the first half cycle, although the delays imposed in steps 1314 and 1326 differ because of the differences in execution time for other instructions in the two half cycles.

During the second half cycle, the microcontroller 202 decrements the cycle counter, as block 1334 indicates, and then determines whether the cycle count has reached zero, as block 1336 indicates. If the cycle count has not reached zero, the routine returns to step 1310, in which the transducer signal is again reversed, and signal generation continues. If the cycle count has reached zero, however, the burst has come to an end, so XMIT− is set equal to zero to remove the voltage from the transducer, as block 1338 indicates. In step 1340, the microcontroller switches to the slow clock, as block 1336 indicates. The microcontroller 202 then returns to the main loop.

Clearly, the beep does not have to be the signal represented by FIGS. 14, 15A, and 15B; there are undoubtedly other signals that would work as well. The reason for generating the relatively complicated signal depicted in those drawings is that the transducers are arranged to resonate at the ultrasonic frequencies used for device detection, and they are considerably less efficient at generating the lower frequencies necessary to produce an audible signal, so the sound amplitudes possible with the particular transducers and drive circuitry that we employed are therefore relatively low. At such amplitudes we have found that the complicated signal depicted in the drawings is more likely to bring itself to the attention of a user close to the faucet than simple single-frequency tones are. At the same time, the sound is generally undetectable by persons positioned a moderate distance from the faucet.

The low-battery indicator is designed to start at about four weeks before the battery is dead, giving the user ample time to replace it.

In view of the foregoing description, it is apparent that the flow-control system of the present invention provides significant advantages. By keeping track of an "average" distance of a stationary object, the system is able to reduce the frequency with which water flow results from apparent motion caused by reflections or from actual motion caused by objects, such as water droplets, whose motion should not cause water to flow or continue flowing. By using the same transducer to produce both audible-sound alarms and ultrasound for sensing, the arrangement can be provided at a relatively low cost. Also contributing to the low cost of the system is a circuit for driving the electric valve. That circuit drives the valve in two directions from a single voltage source, eliminating the need for a second voltage source. The system of the present invention thus provides for reliable automatic control of water flow at low cost and thus constitutes a significant advance in the art.

We claim:

1. A flow-control system, adapted for connection to an electrically operated valve that operates between open and closed states in response to electrical control signals applied thereto, for applying control signals to the electrically operated valve, the flow control system comprising:

A. a position sensor for repeatedly sensing the distances to objects and for generating distance signals representing the sensed distances; and B. control means responsive to the distance signals for computing an average-distance value from the sensed distances and for applying control signals to the valve to open and close it in accordance with predetermined criteria applied to the sensed distances, which criteria are different when the sensed distance is greater than the average-distance value from what they are when the sensed distance is less than the average-distance.

2. A flow-control system, adapted for connection to an electrically operated valve that operates between open and closed states in response to electrical control signals applied thereto, for applying control signals to the electrically operated valve, the flow control system comprising:

A. a position sensor for repeatedly sensing the distances to objects and for generating distance signals representing the sensed distances; and B. control means responsive to the distance signals for computing an average-distance value from the sensed distances and for applying control signals to the valve to open and close it in accordance with one of at least two different sets of predetermined criteria applied to the sensed distances, one set of criteria being applied when the sensed distance differs by more than a predetermined difference value from the average-distance value, a different set of criteria being applied when the sensed distance differs by less than the predetermined difference value from the average-distance value.

3. A flow-control system, adapted for connection to an electrically operated valve that operates between open and closed states in response to electrical control signals applied thereto, for applying control signals to the electrically operated valve, the flow-control system comprising:

A. a position sensor for repeatedly detecting objects, the position sensor including an acoustic transducer, means for driving the transducer to cause it to emit ultrasound, and means for detecting echoes produced by objects in the path of the ultrasound and thereby detecting the objects; and B. means for detecting an alarm condition and driving the acoustic transducer to cause it to emit audible sound in response to the detected alarm condition.

4. A flow-control system as defined in claim 3 wherein the flow-control system includes a power supply and the alarm condition is the low-output state of the power supply.

5. A flow-control system as defined in claim 4 wherein the power supply is a battery.

6. A flow control system, adapted for connection to an electrically operated valve that operates between open and closed states in response to electrical control signals applied thereto, for applying control signals to the electrically operated valve so as to permit flow in the open state and prevent it in the closed state, the flow-control system comprising:

A. a position sensor for repeatedly monitoring a region for the presence of objects;

B. control means, responsive to the position sensor, for generating electrical control signals and applying them to the electrically operated valve to control its state in accordance with the results of the monitoring; and C. detection means for detecting an alarm condition and generating audible sound in response to the detected alarm condition, the detection means being responsive to the control means to begin the audible sound only after the control means has closed the valve.

* * * * *